US006192982B1

(12) United States Patent
Divis et al.

(10) Patent No.: US 6,192,982 B1
(45) **Date of Patent: *Feb. 27, 2001**

(54) SYSTEM FOR INDIVIDUAL INFLATION AND DEFLATION OF BOREHOLE PACKERS

(75) Inventors: Jan J. Divis, North Vancouver; Franklin D. Patton, West Vancouver, both of (CA)

(73) Assignee: Westbay Instruments, Inc., North Vancouver (CA)

( * ) Notice: Subject to any disclaimer, the term of this patent is extended or adjusted under 35 U.S.C. 154(b) by 0 days.

(21) Appl. No.: 09/149,543

(22) Filed: Sep. 8, 1998

(51) Int. Cl.[7] ..... E21B 23/06; E21B 33/127

(52) U.S. Cl. ..... 166/187; 166/191; 137/625.38; 251/63; 251/63.5; 277/333

(58) Field of Search ..... 166/151, 187, 166/191; 277/333; 137/625.38; 251/63, 63.5, 900

(56) References Cited

U.S. PATENT DOCUMENTS

| | | | | |
|---|---|---|---|---|
| 1,224,221 | * | 5/1917 | Schwanebeck | 137/113 |
| 2,358,228 | * | 9/1944 | Hoof | 137/113 |
| 3,291,219 | | 12/1966 | Nutter . | |
| 3,373,820 | | 3/1968 | Robinson, Jr., et al. . | |
| 3,633,606 | * | 1/1972 | Hay et al. | 137/113 |
| 3,908,169 | | 9/1975 | Schufy et al. . | |
| 4,145,025 | * | 3/1979 | Bergeron | 251/63 |
| 4,192,181 | | 3/1980 | Patton et al. . | |
| 4,204,426 | | 5/1980 | Patton et al. . | |
| 4,230,180 | | 10/1980 | Patton et al. . | |
| 4,254,832 | | 3/1981 | Patton et al. . | |
| 4,258,788 | | 3/1981 | Patton et al. . | |

(List continued on next page.)

FOREIGN PATENT DOCUMENTS 2 036 137 6/1980 (GB) .

OTHER PUBLICATIONS

Hall, Stephen H., et al., Invention Report, Battelle Pacific Northwest Laboratories, Jun. 1, 1992, 14 pages.

Weiss, R., Westbay MP System for Groundwater Monitoring, Technology Data Sheet, Aug. 1993, 2 pages.

"The Westbay MP System," product information, Westbay Instrument, Inc., 6 pages.

Westbay Instruments Inc., "Draft Operation Manual MP55 System Casing Trim Tool Model 030194," Feb. 20, 1995, 6 pages.

*Primary Examiner*—Hoang Dang
(74) *Attorney, Agent, or Firm*—Christensen O'Connor Johnson Kindness PLLC

(57) ABSTRACT

A system for individually controlling the inflation and deflation of individual packers mounted on a casing is disclosed. The system includes a packer valve (36) mounted on the casing (24). The valve is in fluid communication with one of the packers (28). A probe (124) is movable within the casing to access packer valve to inflate or deflate the related packer (28). The packer valve includes a body having a bore (40), a valve closure conduit (42) and a valve opening conduit (44), each in communication with the bore. In one embodiment, the valve further includes a packer inlet/outlet conduit (50) connecting the bore to the packer, and a packer/valve conduit (54) in communication with the bore (40) and the packer inlet/outlet conduit. In another embodiment, the bore is directly communicated with the interior of the packer. The packer valve also includes a valve pin (41) reciprocatably mounted in the bore. The probe (124) has a valve opening fluid line that, when connected to the valve opening conduit, causes the valve pin to move to a valve open position. When in the packer valve open position, the packer can be inflated or deflated by continuing to apply fluid pressure to the valve opening conduit or removing fluid pressure therefrom, to inflate or deflate the packer. The probe has a valve closing fluid line that, when connected to the valve closure conduit, causes the valve pin to move to a valve closed position and prevent the inflation or deflation of the packer.

31 Claims, 13 Drawing Sheets

U.S. PATENT DOCUMENTS

| | | | | |
|---|---|---|---|---|
| 4,260,164 | * | 4/1981 | Baker et al. | 277/34 |
| 4,653,588 | * | 3/1987 | White | 166/374 |
| 4,694,730 | * | 9/1987 | Krieger et al. | 251/63 |
| 4,711,301 | | 12/1987 | Stringfellow . | |
| 5,018,574 | | 5/1991 | Smith . | |
| 5,242,022 | | 9/1993 | Burton et al. . | |
| 5,358,048 | * | 10/1994 | Brooks | 166/285 |
| 5,366,019 | * | 11/1994 | Brooks | 166/387 |
| 5,366,020 | * | 11/1994 | Berzin et al. | 166/387 |
| 5,460,224 | | 10/1995 | Schalla et al. . | |
| 5,704,425 | | 1/1998 | Divis et al. . | |

* cited by examiner

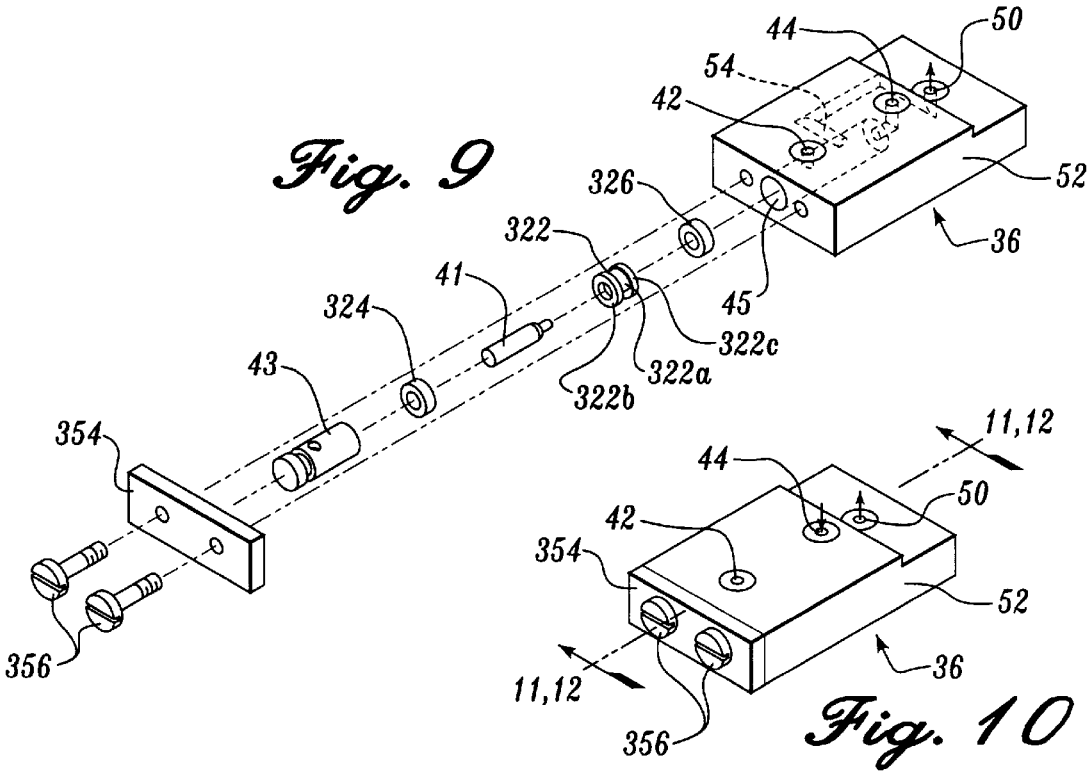
Fig. 9
Fig. 10
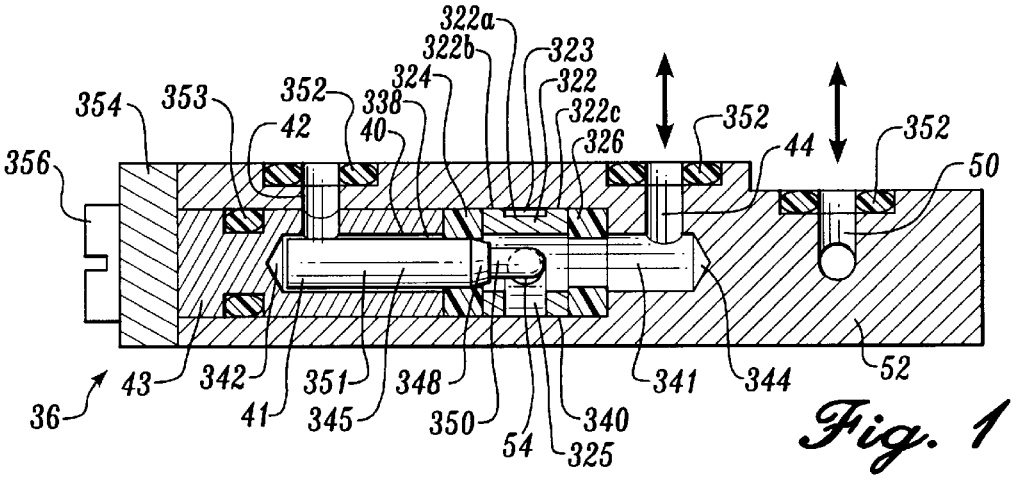
Fig. 11
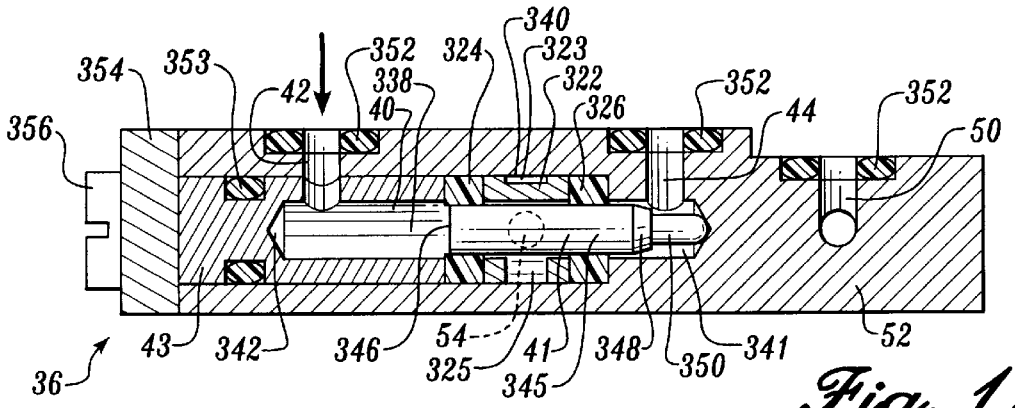
Fig. 12

SYSTEM FOR INDIVIDUAL INFLATION AND DEFLATION OF BOREHOLE PACKERS

FIELD OF THE INVENTION

This invention generally relates to sample analyzing probes and to below-ground casings that are secured in a borehole with inflatable packers or bladders and, in particular, to systems for inflation and deflation of the packers.

BACKGROUND OF THE INVENTION

Land managers wishing to monitor the groundwater on their property have recognized the advantages of being able to divide a single borehole into a number of zones to allow monitoring of groundwater in each of those zones. If each zone is sealed from an adjacent zone, an accurate picture of the groundwater can be obtained at many levels without having to drill a number of boreholes that each have a different depth. A groundwater monitoring system capable of dividing a single borehole into a number of zones is disclosed in U.S. Pat. No. 4,204,426 (hereinafter the '426 patent). The monitoring system disclosed in the '426 patent is constructed of a plurality of casings that may be connected together in a casing assembly and inserted into a well or borehole. Some of the casings may be surrounded by a packer element made of a suitably elastic or stretchable material. The packer element may be inflated with fluid (gas or liquid) or other material to fill the annular void between the casing and the inner surface of the borehole. In this manner, a borehole can be selectively divided into a number of different zones by appropriate placement of the packers at different locations in the casing assembly. Inflating each packer isolates zones in the borehole between adjacent packers.

The casings in a casing assembly may be connected with a variety of different types of couplers. One type of coupler that allows measurement of the quality of the liquid or gas in a particular zone is a coupler containing a valve measurement port (hereinafter the measurement port coupler). The valve can be opened from the inside of the coupler, allowing liquid or gas to be sampled from the zone surrounding the casing.

To perform sampling, a special measuring instrument or sample-taking probe is provided that can be moved up and down within the interior of the casing assembly. The probe may be lowered within the casing assembly on a cable to a known point near a measurement port coupler. As disclosed in the '426 patent, when the probe nears the location of the measurement port coupler, a location arm contained within the probe is extended. The location arm is caught by a helical shoulder that extends around the interior of the measurement port coupler. The location arm slides down the helical shoulder, rotating the sample-taking probe as the probe is lowered. At the bottom of the helical shoulder, the location arm reaches a stop that halts the downward movement and circumferential rotation of the probe. When the location arm stops the probe, the probe is in an orientation such that a port on the probe is directly adjacent to, and aligned with, the measurement port contained in the measurement port coupler.

When the probe is adjacent the measurement port, a shoe is extended from the sample-taking probe to push the probe in a lateral direction within the casing. As the shoe is fully extended, the port in the probe is brought into contact with the measurement port in the measurement port coupler. At the same time that the probe is being pushed against the measurement port, the valve within the measurement port is being opened. Simultaneously, with the movement of the measurement port valve, a hydraulic seal is made around the measurement port to connect the port on the probe with the fluid outside the measurement port coupler. The probe may therefore sample the gas or liquid contained in the zone located outside of the measurement port coupler. Depending upon the particular instruments contained within the probe, the probe may measure different characteristics of the exterior gas or liquid in the zone being monitored such as the pressure, temperature, or chemical composition. The probe may also allow samples of gas or liquid from the zone immediately outside the casing to be stored and returned to the surface for analysis.

After the sampling is complete, the location arm and the shoe lever of the probe may be withdrawn, and the probe retrieved from the casing assembly. It will be appreciated that the probe may be raised and lowered to a variety of different zones within the casing assembly, in order to take samples at each of the zones. A land manager may select the type of probe and the number and location of the zones within a borehole to configure a groundwater monitoring system for a particular application. The expandability and flexibility of the disclosed groundwater monitoring system therefore offers a tremendous advantage over prior art methods requiring the drilling of multiple sampling wells.

Currently, packer inflation and deflation are typically accomplished by attaching all of the packers in series to a single fluid line with fluid dispensed from a surface location. Each packer is attached to the single fluid line with a spring-biased valve. The spring tension of each valve is the same so that passage of fluid of a predetermined pressure through the single fluid line will open all of the valves and cause the simultaneous inflation of all of the packers. The above packer inflation system suffers from several disadvantages, all associated with the fact that the same pressure is applied to all of the packers. Applying the same pressure to all of the packers is undesirable in environments where packers located in different underground zones encounter different external pressures. In such an environment, the same packer pressure can result in some packers being overinflated and others underinflated. Additionally, different packers may have a slightly different resilience such that slightly greater or slightly less internal pressure may be necessary to expand a packer to a predetermined size. Again, the difference in resilience can result in packer overinflation or underinflation. Furthermore, the distance between the borehole and the below-ground casings is not entirely uniform throughout the length of the borehole. As a result, some packers must thus expand a greater distance from the casings than others in order to fill the void between the casings and the borehole. This is difficult to accomplish if variable packer inflation is not an option.

Minute variations in spring tension naturally occur in springs, and spring tension can change over time due to spring corrosion or fatigue. If the spring tension of all of the packer valves is not the same, some valves may not open to inflate a packer when other valves open. Spring-biased packer valves are sensitive to the fluid pressure inside the casing. For example, a high fluid pressure inside the casing could cause the valve to open and a high and destructive pressure to be applied to the interior of the expanding membrane of the packer, causing it to burst or otherwise fail. The use of spring-biased valves has another disadvantage. Specifically, spring-biased valves fail when the spring in a valve fails. Finally, the tension of the spring of a spring-biased valve imparts a minute pressure to pressure sensors, thus affecting pressure measurement accuracy, should it be desirable to know the packer inflation pressure.

In another method described in U.S. Pat. No. 4,230,180 (hereinafter the '180 patent), a probe is lowered to each packer and fluid is injected in packers one at a time. However, the '180 patent uses a spring-biased valve for each packer and, thus, has the same problems that are associated with spring-biased inflation valves, including the problem that spring-biased valves generally open to permit flow in one direction only. Therefore, such valves are not useful for deflating packers.

In order to solve the above-mentioned problems associated with a plurality of packers serially connected to a single inlet line, a separate fluid line for each packer has been used. The disadvantages associated with using a different fluid line for each packer include the redundancy of using multiple lines. Using multiple lines is more costly, occupies valuable casing space, and increases the likelihood of failure of one or more of the packers or lines. Also, there is typically a practical limit of about 6 to 12 lines that can be installed through adjacent packers, thereby limiting the number of packers that can be installed in a single borehole. However, there is frequently a need to install 20 to 40 or more packers in a single borehole. In such a case, the use of individual lines is impractical.

A need thus exists for a system for individually inflating and deflating an unlimited number of packers used to support a below-ground casing within a borehole that, preferably, avoids the use of spring-biased valves. The present invention is directed to fulfilling this need.

SUMMARY OF THE INVENTION

A system for controlling the inflation and deflation of packers mounted on a casing is disclosed. The system includes a plurality of valves mounted on the casings, each one in fluid communication with one of the packers. A probe is movable within the casing to access each valve to inflate or deflate individual packers. Each valve includes a body having a bore, a valve closure conduit and a valve opening conduit each in communication with the bore. In one version for metal components, a packer inlet/outlet conduit connects the bore to the related packer, and a packer/valve conduit is in communication with the bore and with the packer inlet/outlet conduit. In another version for plastic components, the bore communicates directly with the interior of the packer when the valve is in an open position. The valve includes a pin that is reciprocatable in the bore. The pin is moved to a first position when fluid enters the valve closure conduit, and the fluid trapped near the valve opening conduit is permitted to escape. In the first position, the pin blocks the packer/valve conduit or the valve's interface with the packer. This prevents fluid in the packer from exiting therefrom by passing through the packer inlet/outlet conduit, through the packer/valve conduit, or directly from the interior of the packer, and out of the valve through the valve opening conduit. The pin is moved to a second position when fluid enters the valve opening conduit and the fluid trapped near the valve closure conduit is permitted to escape. In the second position, the pin is locked away from the packer/valve conduit or the valve's interface with the packer. This allows fluid to pass out of the packer, either through the packer inlet/outlet conduit and the packer/valve conduit, or directly, and out of the valve opening conduit, resulting in the packer being deflated when fluid pressure in the packer is greater than at the valve opening conduit. When fluid pressure at the valve opening conduit is greater than fluid pressure in the packer, the above configuration allows fluid to pass into the valve opening conduit, and into the packer, resulting in the packer being inflated.

The probe is movable within the inner diameter of the casing and packers. The probe has a valve opening fluid line terminating in a valve opening port and a valve closure fluid line terminating in a valve closure port. The valve opening port and the valve closure port are both located in a fluid port on the probe. The probe is orientable in the casing to align the fluid port of the probe with individual valves. When the fluid port of the probe is aligned with a valve, the closure conduit of the valve is in communication with the closure port of the probe and the opening conduit of the valve is in communication with the opening port of the probe. Either conduit so arranged can be connected to or hydraulically isolated from the fluid inside the casing. Fluid is supplied to the probe through a fluid line connected to a surface fluid source. In one embodiment, fluid passing through the valve opening fluid line enters the valve opening conduit of the valve and moves the valve pin away from the packer/valve conduit, allowing fluid to pass from the opening conduit of the valve, through the packer/valve conduit, through the packer inlet/outlet conduit, and into the packer. As a result, the packer is inflated, provided, of course, that the pressure of the fluid in the valve opening fluid line of the probe is greater than the pressure of the fluid in the packer. In another embodiment, fluid entering the valve opening conduit of the valve moves the valve pin away from the valve's interface with the packer, allowing fluid to pass directly into the packer. If fluid pressure in the packer is greater than pressure in the valve opening fluid line of the probe (that is, the fluid pressure inside the casing), the packer is deflated. After inflation, fluid pressure in the valve closure fluid line is increased. The fluid flows from the valve closure fluid line through the valve closure conduit in the valve moving the valve pin to the position where the pin blocks the packer/valve conduit in the valve, or the valve's interface with the packer. This prevents fluid in the packer from exiting the packer. After closure, the pressure outside the valve can be monitored to confirm that the valve is not leaking.

In accordance with another aspect of the invention, one embodiment of the valve includes a sleeve in the bore that surrounds the pin. The sleeve guides reciprocation of the pin. A pair of O-rings longitudinally spaced along the pin are located between the valve closure conduit and the valve opening conduit of the valve to divide the bore of the valve into a central fluidtight compartment and two adjacent compartments on either side of the central fluidtight compartment. The pin reciprocates between the three compartments.

The probe preferably includes an extendible shoe braceable against the interior surface of the tubular casing. The shoe moves the probe laterally within the tubular casing to align the valve opening port and the valve closure port of the probe with the valve opening conduit and the valve closure conduit of the valve. An elastomeric hydraulic seal is located on the exterior surface of the probe around the exterior of each port. These seals mate with the interior surface of the tubular casing when the shoe on the probe is extended. The probe also includes a location member that is mateable with a track on the interior surface of the tubular casing to align the valve and the fluid port of the probe.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein:

FIG. 9 is an exploded perspective view of the packer valve of the valve system of the present invention;

FIG. 10 is a perspective view of the packer valve of FIG. 9;

FIG. 11 is a sectional view taken at section line 11—11 of FIG. 10 showing the packer valve pin in the open position;

FIG. 12 is a sectional view taken at section line 12—12 of FIG. 10 showing the packer valve pin in the closed position;

DETAILED DESCRIPTION OF THE PREFERRED EMBODIMENT

Figure 1:
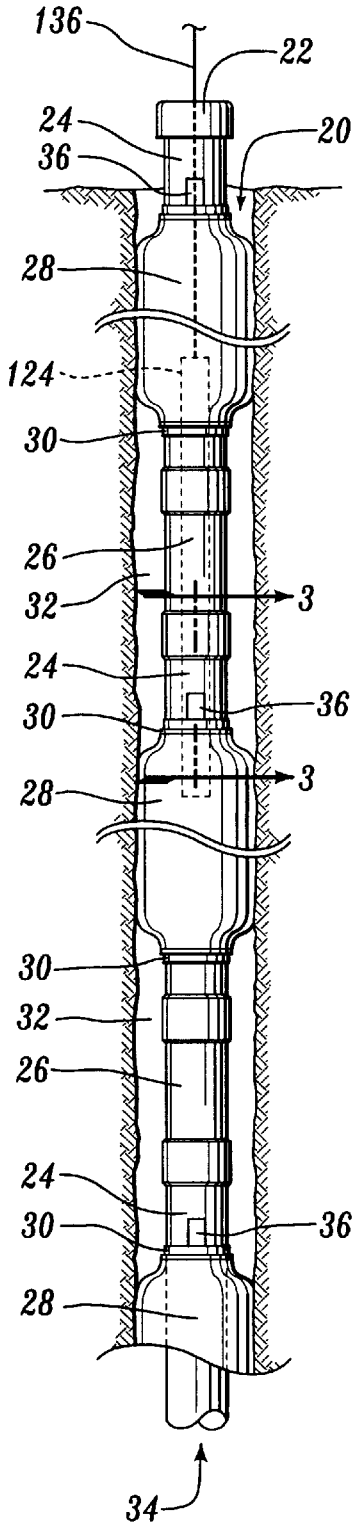
FIG. 1 is a diagram of a borehole in which geological casings are connected by measurement port couplers to form a casing assembly.

A cross section of a typical well or borehole 20 with which the individual packer inflation and deflation system of the present invention may be used is shown in FIG. 1. Lowered into well or borehole 20 is a casing assembly 22. The casing assembly is constructed of a plurality of elongate casings 24 that are connected by measurement port couplers 26. Selected casings 24 are surrounded by packers 28. The packers 28 are formed of a membrane or bag that is elastic or stretchable, such as natural rubber, synthetic rubber, or a plastic such as urethane. Urethane is preferred because it is readily moldable, and has high strength and abrasion characteristics. The packer 28 is clamped on opposite ends of elongate casing 24 by circular fasteners or clamps 30. The ends of each casing project beyond the ends of the packer to allow the casings to be joined together to form the casing assembly.

The packers 28 are expanded to fill the annular space between the elongate casings 24 and the interior walls of the borehole 20. The expansion of the packers 28 divides the borehole into a plurality of zones 32 that are isolated from each other. The number of zones that the borehole 20 is divided into is determined by a user, who may selectively add elongate casings 24, packers 28, and couplers 26 to configure a multilevel groundwater monitoring system for a given application.

Further details about the multilevel groundwater monitoring system of the type shown in FIG. 1 can be found in U.S. Pat. Nos. 4,192,181; 4,204,426; 4,230,180; 4,254,832; 4,258,788; and 5,704,425; all assigned to Westbay Instruments, Ltd. and expressly incorporated herein by reference.

In the packer inflation and deflation system of the present invention, the interior of the casings 24 and the measurement port couplers 26 form a continuous passageway 34 that extends the length of the casing assembly 22. A packer inflation/deflation probe 124 is lowered from the surface by a cable 136 to any desired level within the casing assembly. As will be described in further detail below, each packer 28 is in fluid communication with a packer valve 36 having ports accessible from the interior of the casing assembly 22. The packer inflation/deflation probe 124 is lowered until it is adjacent the ports of a desired packer valve 36. The packer inflation/deflation probe 124 is then operated to actuate the packer valve 36. Actuation of the packer valve 36 causes the related packer 28 to either inflate or deflate.

The elongate casing 24 is generally tubular in shape. The ends of the elongate casing 24 are inserted into the ends of the couplers 26 until they come into contact with a stop in couplers 26 formed by a narrowing of the internal passageway of couplers 26 to a smaller diameter. Suitable means for mating each of the couplers 26 to the elongate casings 24 are provided. Preferably, an O-ring gasket (not shown) is contained in the end of each coupler 26 to provide a watertight seal between the exterior wall of the elongate casing 24 and the interior wall of the measurement port coupler 26. A flexible lock ring or wire (not shown) located in a groove in the measurement port coupler 26 or threads are used to lock the elongate casing 24 onto the measurement port coupler 26. When assembled, the elongate casings 24 and measurement port couplers 26 will be aligned along a common axis. The interior or bore of the elongate casings 24 has approximately the same diameter as the interior or bore of the couplers 26. A continuous passageway is therefore created along the length of the casing assembly 22.

Figure 3:
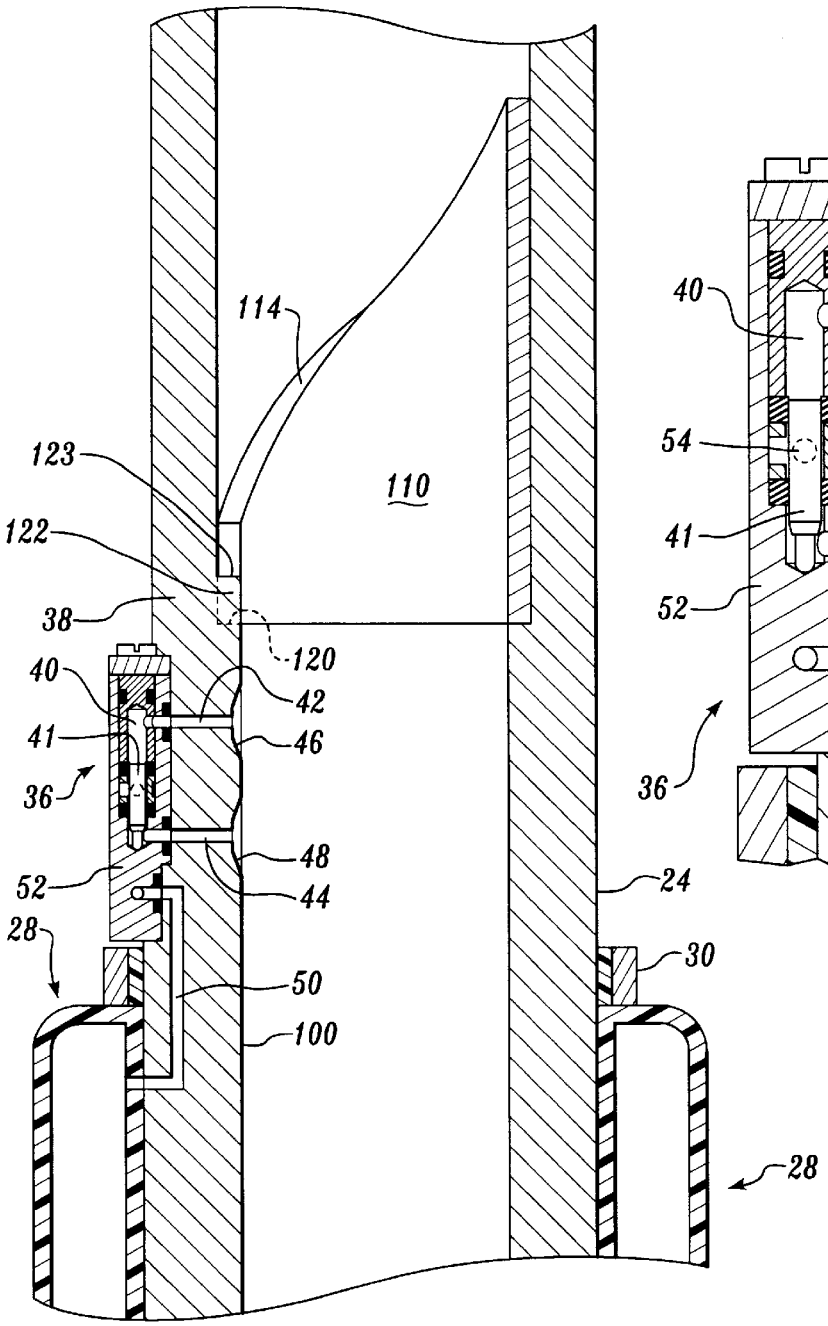
FIG. 3 is a longitudinal section view of the elongate casing and valve of the system of the present invention taken along section line 3—3 of FIG. 1.
Figure 4:
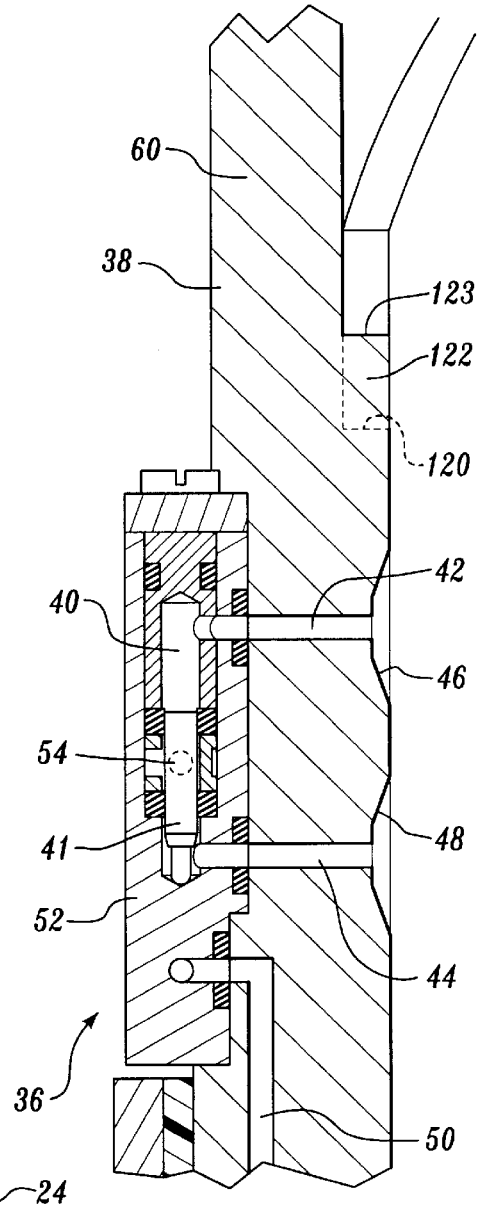
FIG. 4 is an expanded cross section view of the elongate casing and valve of FIG. 3.

A preferred embodiment of the elongate casing 24 and packer valve 36 of the packer inflation and deflation system of the present invention is illustrated in FIGS. 3 and 4. The packer valve 36 is secured to the exterior surface of wall 38 of the related elongate casing 24 by any suitable mechanism, for example, a suitable adhesive, screws, or metal or other bands. Preferably, the longitudinal axis of elongate casing 24 and the longitudinal axis of the valve 36 are parallel. As will be better understood from the following detailed description of the packer valve 36, the valve includes a bore 40 and a pin 41 that is longitudinally reciprocatable within the bore 40. A valve closure conduit 42 that extends through the wall 38 of the elongate casing 24 provides fluid communication between one end of the bore 40 and the interior of the elongate casing 24. A valve opening conduit 44 that also extends through wall 38 provides fluid communication between the other end of the bore 40 and the interior of elongate casing 24. A closure port 46 is located on the end of the valve closure conduit 42 communicating with the interior of elongate casing 24. An opening port 48 is located on the end of the valve opening conduit 44 communicating with the interior of the elongate casing 24. The closure port 46 and the opening port 48 are preferably semispherical openings with flattened central bases configured to receive mating portions of the packer inflation/deflation probe 124 described in further detail below. A packer inlet/outlet conduit 50 that extends generally longitudinally through the wall 38 of the elongate casing 24 provides fluid communication between the associated packer 28 and the body 52 of packer valve 36. The end of the packer inlet/outlet conduit 50 located at the body 52 of the valve 36 is in fluid communication with a packer/valve conduit 54. The packer/valve conduit 54 terminates at the bore 40. The fluid path through valve closure conduit 42, valve opening conduit 44, packer inlet/outlet conduit 50 and packer/valve conduit 54 facilitates the inflation and deflation of packer 28 in the manner described below.

Figure 2A:
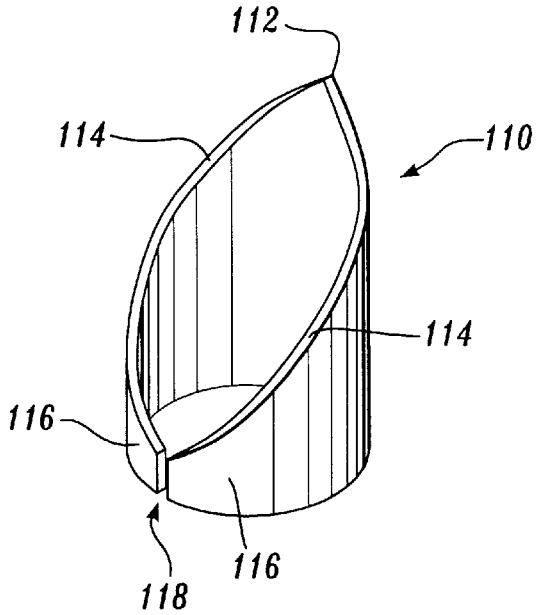
FIG. 2A is a side elevation view of a helical insert for use in an elongate casing.

With respect to FIGS. 2A, 3, and 4, the middle portion 60 of the elongate casing 24 is constructed to allow insertion of a helical insert 110. The helical insert 110 is nearly cylindrical, with two symmetric halves that taper downwardly from an upper point 112 in a helical shoulder 114 before terminating at outer ends 116. A slot 118 separates the two halves of the insert between the outer ends 116.

The helical insert 110 may be fitted within the elongate casing 24 by insertion therein until the helical insert 110 contacts a stop 120 formed by a narrowing of the interior of elongate casing to a smaller diameter. A locating tab 122 protrudes from the interior surface of the elongate casing 24 to ensure proper orientation of the helical insert 110 in the elongate casing 24. When properly inserted, the locating tab 122 fits within the slot 118 so that each helical shoulder 114 slopes downward toward the upper surface 123 of the locating tab 122. As will be described in further detail below, the locating tab 122 is used to correctly orient the packer inflation/deflation probe 124 with respect to the closure and opening ports 46 and 48 provided on the interior surface of the elongate casing 24. The locating tab 122 further serves to expand the diameter of the helical insert 110 to provide an interference fit. Thus, the helical insert 110 is preferably formed of flexible material, such as plastic. The helical insert 110 is fixed in place in the elongate casing 24 by manufacturing the helical insert 110 to have a slightly larger diameter than the elongate casing 24. The halves of the helical insert 110 are flexed toward each other as the helical insert 110 is placed in the elongate casing 24. After insertion, the rebound tendency of the helical insert 110 secures the helical insert 110 against the inner wall of the elongate casing 24. The helical insert 110 is further prevented from travel in the elongate casing 24 by the stop 120, which prevents downward motion, the locating tab 122, which prevents rotational motion and creates pressure against the halves that were flexed during insertion, and another casing (not shown) fixed in the upper end of elongate casing 24, which prevents upward motion.

Figure 2B:
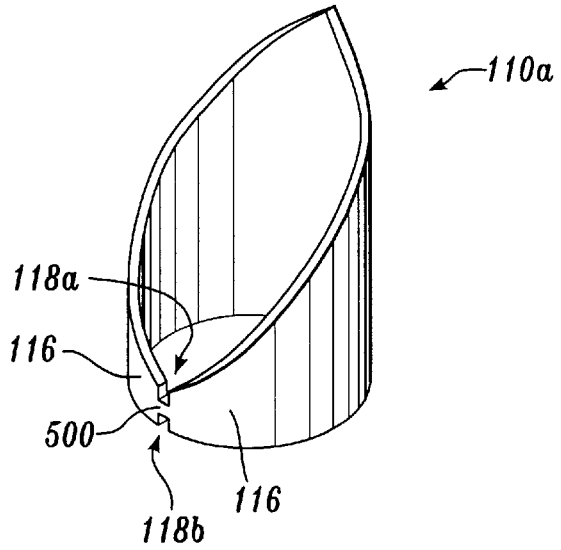
FIG. 2B is a side elevation view of a metallic helical insert for use in a casing.

Forming the helical insert 110 as a separate piece greatly improves the manufacturability of the elongate casing 24. The elongate casing 24 may be made of a variety of different materials, including metals and plastics. Preferably, multi-level monitoring systems are constructed of polyvinyl chloride (PVC), stable plastics, stainless steel, or other corrosion-resistant metals so that contamination will not be introduced when the system is placed in a borehole. When plastic is used, it is very difficult to construct a PVC elongate casing 24 having an integral helical insert 110 without warping. Manufacturing the helical insert 110 separately and then inserting the helical insert 110 into the interior of the casing 24 allow the casing 24 to be constructed entirely of PVC. Constructing the helical insert 110 of a suitable metal, such as stainless steel, can provide improved abrasion resistance to a key component of the plastic elongate casing 24. FIG. 2B illustrates an example of a helical insert 110*a* formed of metal, suitable for use with the present invention. The helical insert 110*a* includes a pin 500 that laterally connects the outer ends 116 so as to form two slots 118*a* and 118*b* between the outer ends 116. In operation, when the helical shoulder 110*a* slopes downward toward the locating tab 122, the tab 122 fits within the slot 118*b*. Securing the helical insert 110 or 110*a* in place without the use of glue further minimizes the contamination that is introduced into the borehole.

Figure 5:
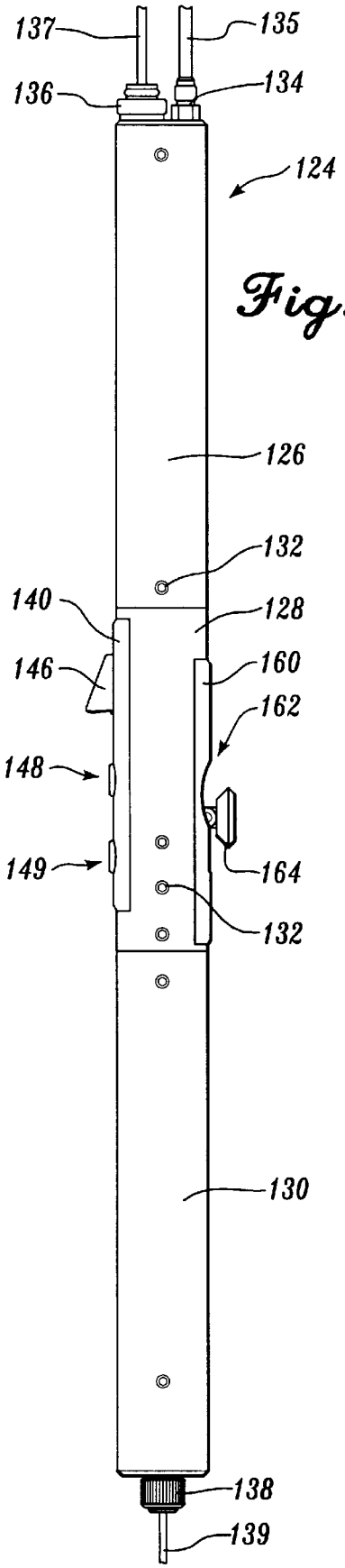
FIG. 5 is a diagrammatic elevation view of the probe of the packer inflation and deflation system of the present invention.
Figure 6:
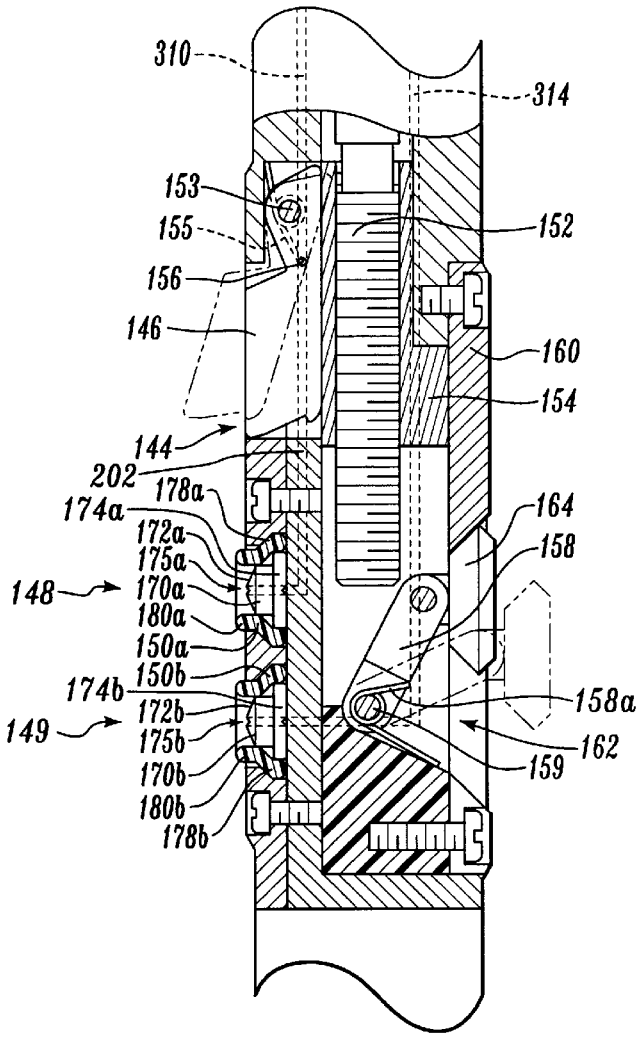
FIG. 6 is a longitudinal section view of the packer inflation/deflation probe shown in FIG. 5 showing the interface for mating with the ports in the elongate casing.

FIGS. 5 and 6 illustrate an exemplary packer inflation/deflation probe 124 of the packer inflation and deflation system of the present invention that is suitable for lowering into the casing assembly 22 to inflate and deflate the packers 28. The packer inflation/deflation probe 124 is generally in the form of an elongate cylinder having an upper section 126, a middle section 128, and a lower section 130. The three sections are connected together by mounting screws 132 to form a single elongate unit. Located at the top of a packer inflation/deflation probe 124 is a fluid coupler 134 that is connected to a fluid line 135. The fluid line 135 provides fluid, such as water or gas, from the surface to the packer inflation/deflation probe 124 that is used to operate the packer valves 36 that control the inflation and deflation of the packers 28. A communications coupler 136 attaches a MOSDAX control cable 137 to the top of the packer inflation/deflation probe 124. The MOSDAX control cable 137 is connected to pressure data-processing equipment (not shown). A second communications coupler 138 located at the bottom of the packer inflation/deflation probe 124 attaches the MOSDAX control cable 139 to pressure data acquisition sensors that gather pressure data from a zone 32 located below the packer 28 aligned with the packer inflation/deflation probe 124.

The middle section 128 of the packer inflation/deflation probe 124 contains an interface designed to mate with the closure port 46 and the opening port 48 of the elongate casing 24. The interface includes a faceplate 140 laterally disposed on the side of the middle section 128. The faceplate 140 is semicylindrical in shape and has an outside diameter that matches the diameter of the inside surface 100 of the elongate casing 24. The faceplate 140 is slightly raised with respect to the outside surface of the cylindrical middle section 128. The faceplate 140 includes a slot 144 that allows a locating arm 146 to extend from the packer inflation/deflation probe 124. In FIG. 5, the locating arm 146 is shown in an extended position where it protrudes from the middle section 128 of the packer inflation/deflation probe 124. The locating arm 146 is normally in a retracted position, as shown in FIG. 6, in which it is generally flush with the surface of the packer inflation/deflation probe 124. In the retracted position, the packer inflation/deflation probe 124 is free to be raised and lowered within the casing assembly 22.

When it is desired to stop the packer inflation/deflation probe 124 at one of the elongate casings 24 to inflate or deflate a packer 28, the packer inflation/deflation probe 124 is lowered or raised until the middle section 128 is positioned slightly above the known position of the packer valve 36. The locating arm 146 is then extended, and the packer inflation/deflation probe 124 slowly lowered, allowing the faceplate 140 to pass through the elongate casing 24. As the packer inflation/deflation probe 124 is lowered further, the locating arm 146 comes into contact with, and then travels downward along, the helical shoulder 114 until the locating arm 146 is caught within notch 118 or 118*a* at the bottom of the helical shoulder 114. The downward motion of the locating arm 146 on the helical shoulder 114 rotates the body of the packer inflation/deflation probe 124, bringing it into a desired alignment position. Alternatively, when the locating arm 146 enters the notch 118, the packer inflation/deflation probe 124 is brought to a halt by the upper surface 123 of the locating tab 122.

Alternatively, when the locating arm 146 enters the notch 118*a*, the probe 124 is halted by the lateral pin 500 (see FIG. 2B). When the locating arm 146 is located on the locating tab 122 or the pin 500, the packer inflation/deflation probe 124 is oriented in the elongate casing 24 such that a valve closure port 148 and a valve opening port 149 on the packer inflation/deflation probe 124 are each aligned, respectively, in mating relationship with the closure port 46 and opening port 48 of the elongate casing 24.

The valve closure port 148 and valve opening port 149 allow fluid to enter or leave the packer inflation/deflation probe 124. As shown in the cross section of FIG. 6, the valve closure port 148 and valve opening port 149 include plungers 170*a* and 170*b*, and elastomeric face seal gaskets 150*a* and 150*b*. The plungers 170*a* and 170*b* are generally cylindrical in shape and include outer protrusions 172*a* and 172*b* that are conical. The plungers 170*a* and 170*b* also include base portions 174*a* and 174*b* having a larger diameter than the diameter of the body of plungers. Bores 175*a* and 175*b*, formed in the plungers 170*a* and 170*b*, respectively, extend through the plungers 170*a* and 170*b*, into the interior of the packer inflation/deflation probe 124 where the bores 175*a*, 175*b* are in fluid communication with a closure line 310 and an opening line 314.

The face seal gaskets 150*a* and 150*b* are formed to surround the plungers 170*a* and 170*b* and protrude beyond the outer surface of the faceplate 140. Each face seal gasket 150*a* and 150*b* has an outer portion 180*a* and 180*b* having an inner diameter sized to surround the outer portion of the related plungers 170*a* and 170*b*, and an inner portion 178*a* and 178*b* having an inner diameter sized to surround the base portion 174*a* and 174*b* of the plungers 170*a* and 170*b*. Each outer portion 180*a* and 180*b* has a rounded outer peripheral surface that is optimized for contact with one of the closure port 46 and the opening port 48 of the elongate casing 24. It will be appreciated that the closure port 46 and the opening port 48, being semispherical with a flat base, simplify the mating geometry of the face seal gaskets 150*a* and 150*b*. Rather than having to mate with a cylindrical surface, which requires a gasket that is curved along two axes, the face seal gaskets 150*a* and 150*b* must be formed to mate with only a semispherical surface along a single axis.

The valve closure port 148 and the valve opening port 149 of the probe 124 are brought into sealing contact with the closure port 46 and the opening port 48 of the elongate casing 24, respectively, by moving the packer inflation/deflation probe 124 laterally within the elongate casing 24. This movement is accomplished by a shoe 164 located in a shoe plate 160 positioned on the side of the middle section 128 opposite the faceplate 140. The shoe plate 160 protrudes slightly from the outer cylindrical surface of middle section 128. The shoe plate 160 is located in an aperture 162 that allows the shoe 164 to be withdrawn into the packer inflation/deflation probe 124. In the extended position, the shoe 164 is brought into contact with the inner surface 100 of the elongate casing 24 and applies a lateral force to the packer inflation/deflation probe 124. The thusly applied force brings the valve closure port 148 and valve opening port 149 of the probe 124 into contact with the closure port 46 and the opening port 48 of the elongate casing 24.

The mechanism for extending the locating arm 146 and the shoe 164 is shown in FIG. 6. A motor (not shown) in the upper section 126 of the packer inflation/deflation probe 124 turns an actuator screw 152 in the middle section 128. When turned in a forward direction, the actuator screw 152 causes a threaded actuator nut 154 to travel along the actuator screw 152 toward a shoe lever 158. The initial turns of the actuator screw 152 move the actuator nut 154 a sufficient distance downward in the middle section 128 of the packer inflation/deflation probe 124 to allow the locating arm 146 to pivot around a pivot pin 153. A coil spring 155 wound around the pivot pin 153 and attached to hole 156 in the locating arm 146 biases the locating arm 146 into the extended position. Additional turns of the actuator screw 152 move the actuator nut 154 further downward in the middle section 128 of packer inflation/deflation probe 124 until the actuator screw 152 contacts a shoe lever 158. As the actuator nut 154 continues to advance, the shoe lever 158 pivots around a pivot pin 159, forcing the shoe 164 to swing outward from the middle section 128 of the packer inflation/deflation probe 124. When the actuator nut 154 reaches a fully advanced position, the shoe 164 is extended, as shown in phantom in FIG. 6. The retraction of the actuator nut 154 reverses the extension process. When the actuator screw 152 is turned in a reverse direction, the actuator nut 154 is moved upward in the middle section 128 of packer inflation/deflation probe 124. As the actuator nut 154 moves upward, the shoe 164 is retracted by a coil spring 158*a* attached to the pivot pin 159 and the shoe lever 158. Continued motion of the actuator nut 154 brings the actuator nut 154 into contact with the locating arm 146, pivoting the arm to a retracted position.

Figure 7A:
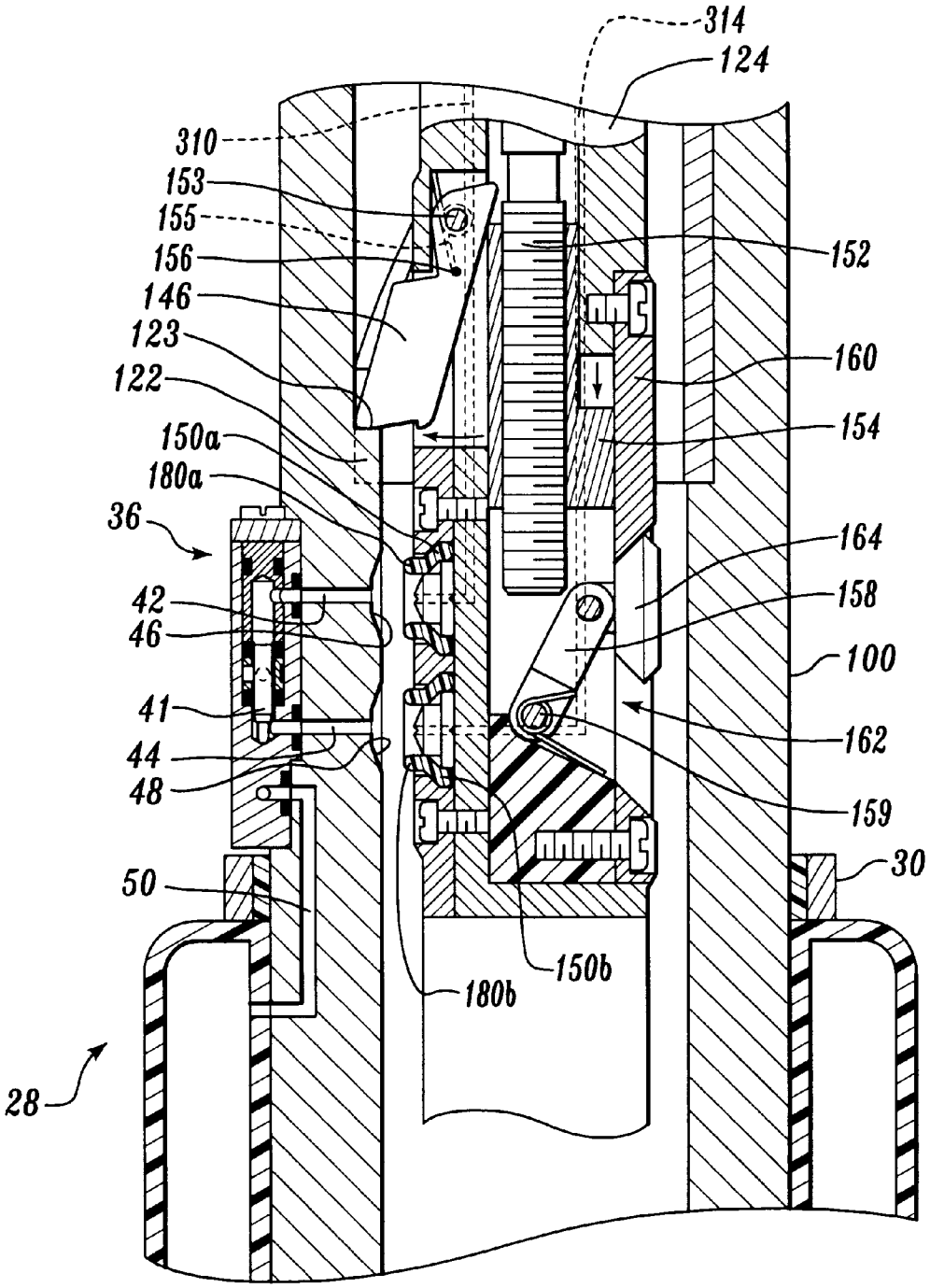
FIGS. 7A–7D are expanded cross section views of the packer inflation and deflation probe shown in FIG. 5 and the ports in the elongate casing showing the sequence of events as the probe is pushed into contact with the ports to allow the packer to be inflated or deflated.

The interaction between the packer valve 36 on the elongate casing 24 and the packer inflation/deflation probe 124 of the system of the present invention may be better understood by the sequence shown in FIGS. 7A through 7D. FIG. 7A shows the packer inflation/deflation probe 124 lowered to the position where the valve closure port 148 and the valve opening port 149 of the probe 124 (see FIG. 6) are aligned with closure port 46 and opening port 48 of the elongate casing 24. As previously described, this position is achieved by extending the locating arm 146 and lowering the packer inflation/deflation probe 124 until the locating arm 146 comes into contact with the upper surface 123 of the locating tab 122, or the upper surface of the pin 500.

Figure 7B:
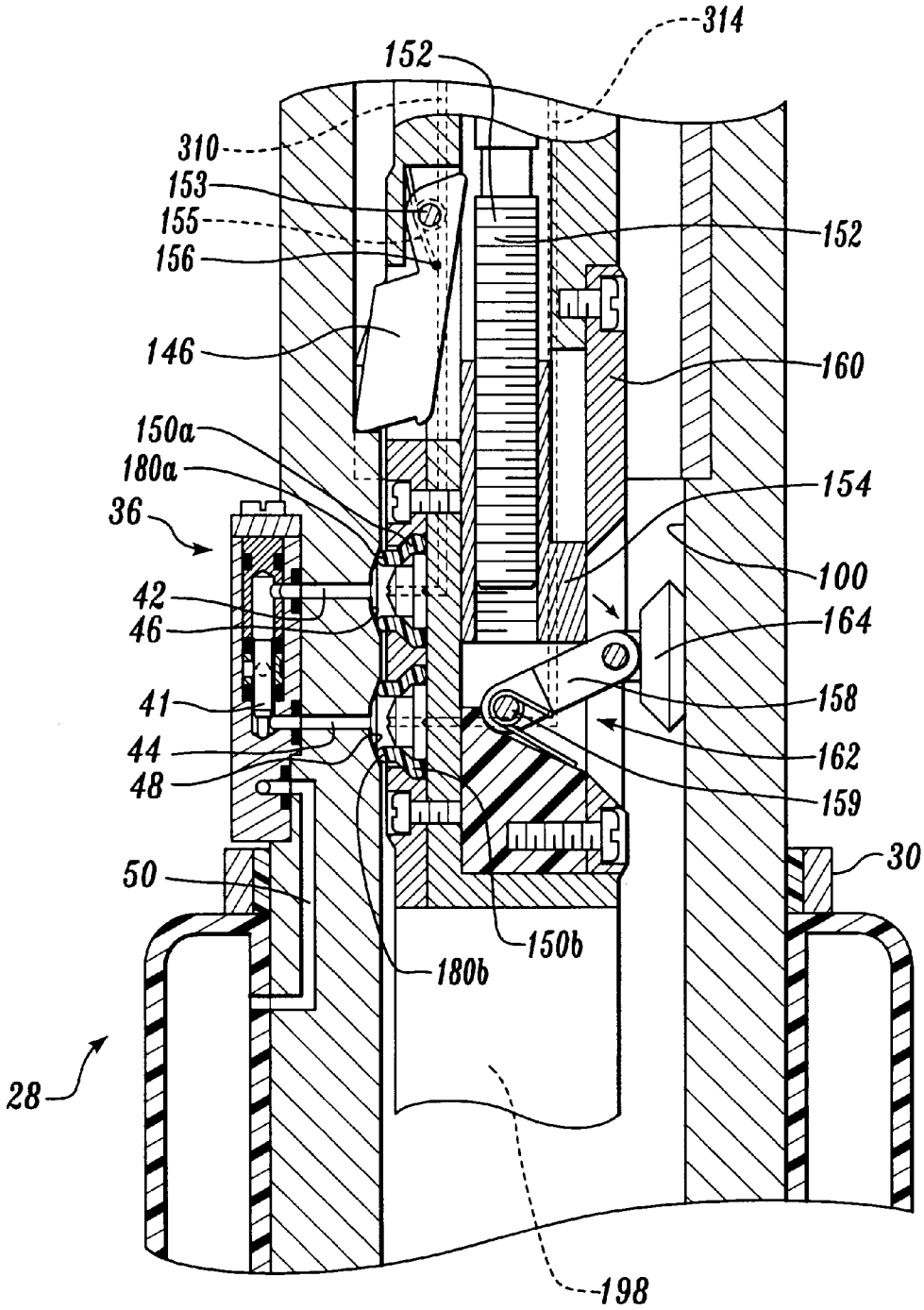

FIG. 7B shows the shoe 164 partially extended from the body of the packer inflation/deflation probe 124. The shoe 164 is in contact with the interior surface 100 of the elongate casing 24. As the shoe 164 continues to extend from the body of the packer inflation/deflation probe 124, the packer inflation/deflation probe 124 is pushed toward the closure port 46 and the opening port 48 of the elongate casing 24. The shoe's force is adequate to swing the locating arm 146 inward, overcoming the force of the coil spring 155, as the packer inflation/deflation probe 124 nears the interior wall of the elongate casing. The outer portions 180*a* and 180*b* of the face seal gaskets 150*a* and 150*b* contact closure port 46 and the opening port 48 of the elongate casing 24. This contact creates two seals between the packer inflation/deflation probe 124 and the closure port 46 and the opening port 48, respectively.

Figure 7C:
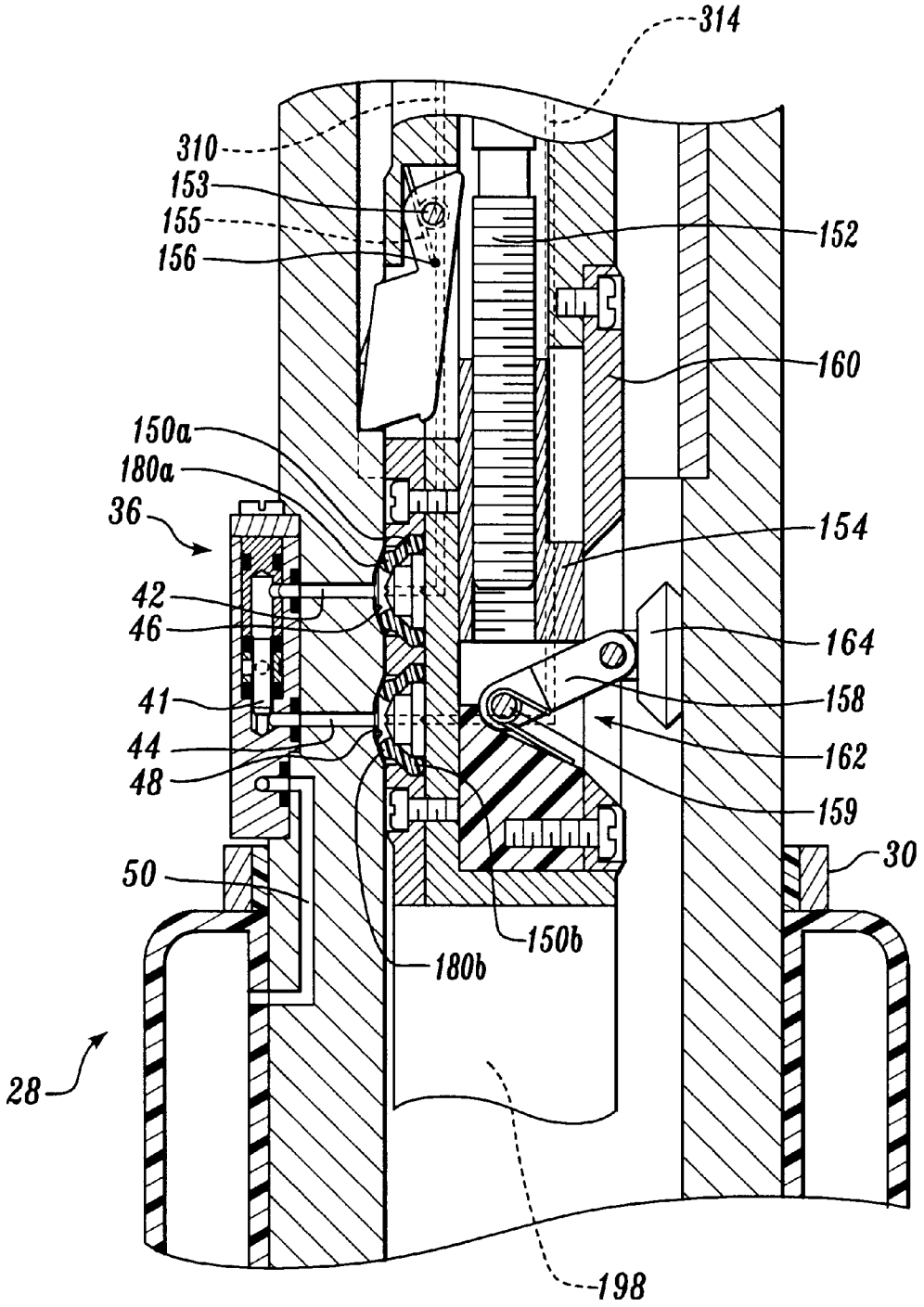

As shown in FIG. 7C, a continued extension of shoe 164 causes the plungers 170*a* and 170*b* to contact the closure port 46 and the opening port 48 of elongate casing 24, thus allowing fluid communication between the closure line 310 of the packer inflation/deflation probe 124 and closure conduit 42 of the valve 36 and between the opening line 314 of the packer inflation/deflation probe 124 and the opening conduit 44 of the valve 36. When the shoe is fully extended, leak-proof seals are created. Thereafter, the packer is inflated or deflated in the manner described below.

When packer inflation or deflation is complete, the packer inflation/deflation probe 124 is released and moved to a different elongate casing 24 to actuate a packer valve 36 for inflation or deflation of another packer 28. Release is accomplished by slowly retracting the shoe 164 into the packer inflation/deflation probe 124. As this occurs, the packer inflation/deflation probe 124 moves through the intermediate position shown in FIG. 7B and described above.

Figure 7D:
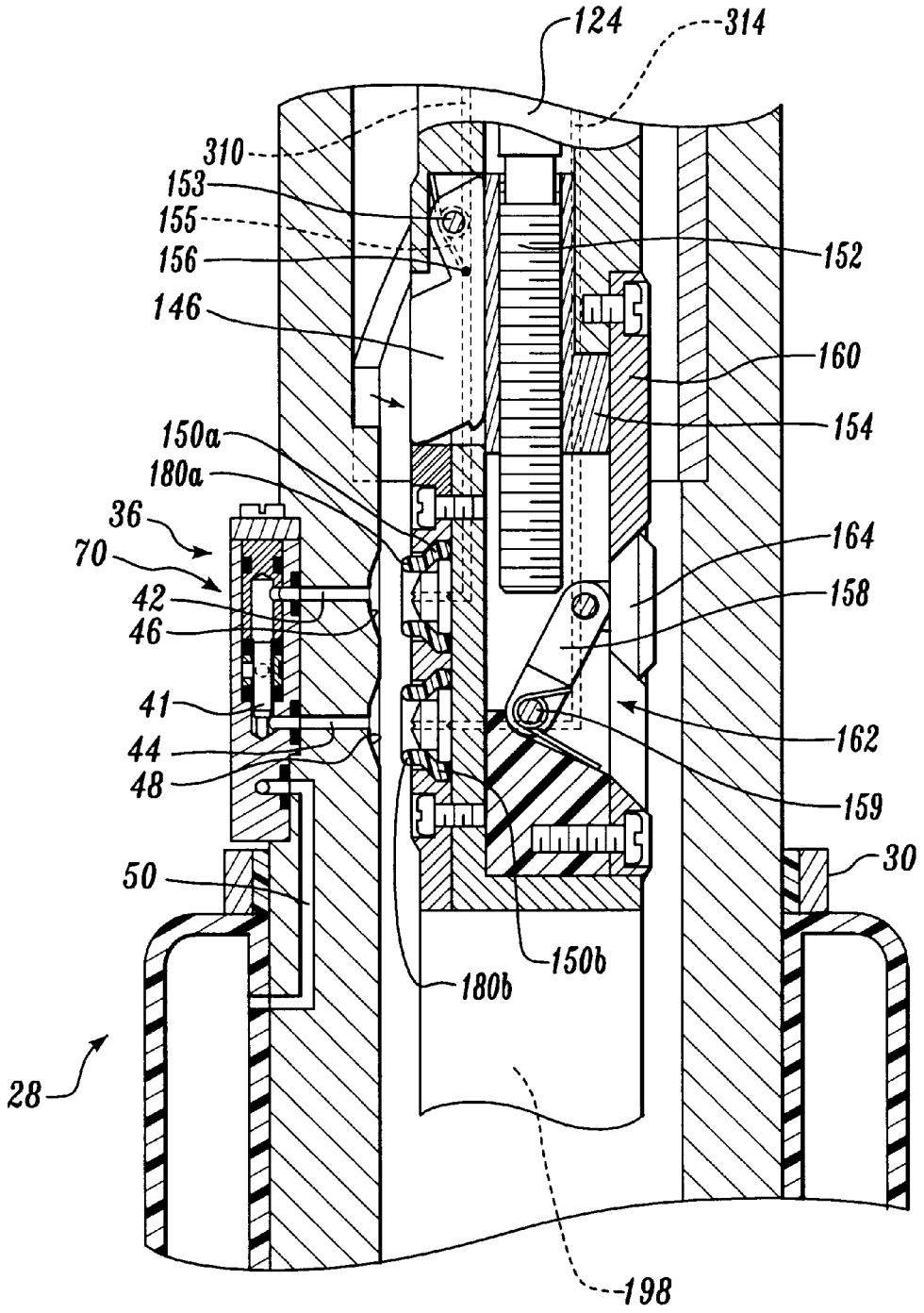

When the shoe 164 and locating arm 146 are fully retracted, as shown in FIG. 7D, the face seal gaskets 150*a* and 150*b* are free to move away from the closure port 46 and the opening port 48 of the elongate casing 24. Thus, the packer inflation/deflation probe 124 is ready to be raised or lowered to a different elongate casing 24.

Figure 8:
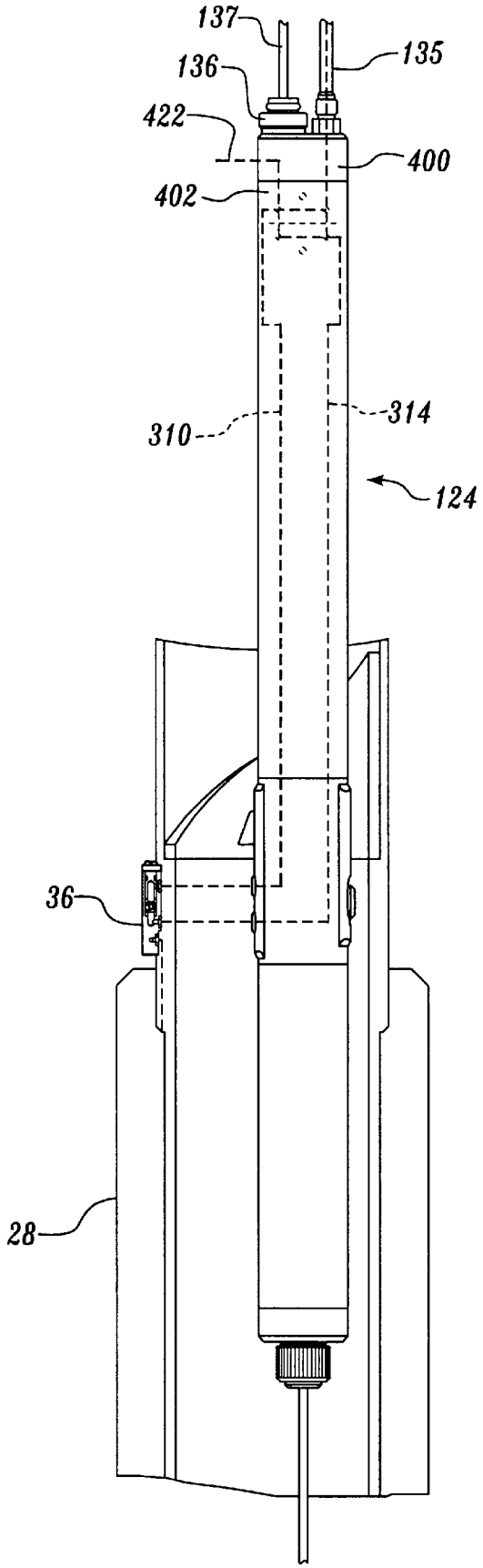
FIG. 8 is a diagrammatic view of the elongate casing, packer valve, and packer inflation/deflation probe.

FIG. 8 shows the overall pathways of the fluid from the packer valve 36 through the valve closure line 310 and the valve opening line 314 in the interior of the packer inflation/deflation probe 124. The probe includes a fluid interface 400 and a fluid manifold 402. As illustrated, one passageway through the fluid interface 400 leads to the exterior of the probe 124 through a vent outlet 422, while the other passageway leads to the fluid line 135, as more fully described below in reference to FIGS. 13 and 14.

FIGS. 9, 10, 11, and 12 show the packer valve 36 of the packer inflation and deflation system of the present invention in more detail. In addition to O-ring seal 353, the body 52, and the pin 41, the packer valve 36 includes a sleeve 43, a guide ring 322, two pin O-ring seals 324, 326, three conduit O-ring seals 352, an end plate 354, and two end plate attachment screws 356. In place of O-ring seals, any suitable fluid seals may be used. The body 52 is preferably formed of a metal alloy and has a low-profile, generally rectangular parallelepiped-shape with a step on one end. The body 52 includes a longitudinal cylindrical chamber 45 having a large diameter portion 340 and a small diameter portion 341. The chamber 45 lies substantially parallel to the longitudinal axis of the body 52. The chamber 45 extends inwardly from the end of the body 52 opposite the step and the large diameter portion 340 lies outwardly of the small diameter portion 341. The chamber 45 preferably extends over at least one-half of the length of body 52.

The sleeve 43 is cylindrical and sized to tolerance fit within the outer end of the large diameter portion 340 of the chamber 45. The sleeve 43 has a central longitudinal chamber 338 that forms part of the bore 40 within which the pin 41 lies. The chamber 338 extends inwardly from the inner end of the sleeve 43 and lies substantially parallel with the longitudinal axis of sleeve 43. The diameter of the chamber 338 in the sleeve 43 and the diameter of the small diameter portion 341 of the cylindrical chamber 45 are substantially the same, and aligned with one another. The inner end of the chamber 338 of the sleeve 43 and the small diameter portion 341 of the cylindrical chamber 45 are spaced from one another. The outer end 342 of the chamber 338 in the sleeve 43 and the outer end 344 of the small diameter portion 341 of the cylindrical chamber 45 are both conic-shaped. The small diameter portion 341 of the cylindrical chamber 45 forms another part of the bore 40 within which the pin 41 lies.

The guide ring 322 and the two pin O-ring seals 324 and 326 are located in the space between the sleeve 43 and the small diameter portion 341 of the cylindrical chamber 45. More specifically, one pin O-ring seal 324 abuts the interior end of sleeve 43. The other pin O-ring seal 326 is located adjacent the small diameter portion 341 of the cylindrical chamber 45. The guide ring 322, which is cylindrically shaped, is located between the pin O-ring seals 324 and 326. Pin O-ring seal 324, pin O-ring 326, and guide ring 332 are thus coaxially aligned between the inner end of the sleeve 43 and the small diameter portion of the cylindrical chamber 45. The exterior of the guide ring 322 includes a small diameter midsection 322*a* and two larger diameter flanges 322*b*, 322*c* located on either end. The exterior diameter of the flanges is substantially the same as the diameter of the larger diameter portion 340 of the cylindrical chamber 45. Thus, an encircling peripheral chamber 323 is formed between the midsection 322*a* of this guide ring 322 and the wall of the large diameter portion 340. The midsection 322*a* of the guide ring includes a slot 325 that communicates between the peripheral chamber 323 and the interior of the guide ring 322. The interior diameter of the guide ring 322 is substantially the same as the interior diameter of the sleeve 43 and the diameter of the chamber 338 of the small diameter portion 341 of the cylindrical chamber 45. These diameters are slightly greater than the diameter of the pin 41. In contrast, the inner diameters of the O-ring seals 324 and 326 are smaller than these inner diameters. The inner diameters of the O-ring seals are sized to tightly fit around and seal the pin 41. The longitudinal apertures through the O-ring seals 324 and 326 and the guide ring 322 form the remainder of the bore 40 within which the pin 41 lies.

Pin 41 includes an elongate body 345. One end 346 of the body 345 is planar. The other end of the pin 41 has a tapered neck 348 that terminates in a head 350. The diameter of the head 350 is less than the diameter of both the neck 348 and the body 345. The pin is oriented in the bore 40 such that the flat end 346 rests near the conic-shaped end 342 of the chamber 338 in the sleeve 43 and the head 350 rests near the conic-shaped end 344 of the small diameter portion 341 of the cylindrical chamber 45. The sleeve O-ring seal 353 lies in an indentation that surrounds the outer end of the sleeve 43.

The valve is assembled by inserting pin O-ring seal 326 into the large diameter portion 340 of the cylindrical chamber 45 until it reaches the bottom of the chamber, adjacent the small diameter portion 341. The guide ring 322 and pin O-ring seal 324 are then inserted in this order. Then the pin 41 is inserted. The sleeve O-ring seal 353 is mounted in the indentation in the sleeve and the sleeve is inserted into the large diameter portion 340 of the cylindrical chamber 45. The assembly is held in place by the end plate 354, which is attached to the end of the body 52, from which the cylindrical chamber extends inwardly, by the end plate attachment screws 356.

Valve closure conduit 42, valve opening conduit 44, packer inlet/outlet conduit 50 and packer/valve conduit 54 are all located in the body 52 of the packer valve 36. The valve closure conduit 42 and the valve opening conduit 44 both lie orthogonal to and communicate with the bore 40. The valve closure conduit 42 is located at the outer end of the chamber 338 in the sleeve 43 and passes through the sleeve as well as through the body. The valve opening conduit 44 is located at the inner end of the small diameter portion 341 of the cylindrical chamber 45. The packer inlet/outlet conduit 50 lies in the step portion of the body 52 and runs parallel to the valve closure and valve opening conduits 42 and 44. The packer/valve conduit 54 extends between the packer inlet/outlet conduit 50 and a hole that is aligned with the midsection of the guide ring 322. Thus, the packer inlet/outlet conduit 50 is in communication with the peripheral chamber 323 that surrounds the midsection 322*a* of the guide ring 322. The three conduit O-ring seals 352 lie in indentations that surround the outer ends of the valve closure conduit 42, the valve opening conduit 44, and the packer inlet/outlet conduit 50, respectively.

FIGS. 11 and 12 show the position of the pin 41 in the valve open position and the valve closed positions, respectively. In the valve open position, the pin 41 is located at the outer end of the bore 40. The pin is moved from the open position to the valve closed position by applying fluid pressure to the valve closure conduit 42 while venting the valve opening conduit 44 to the interior of the casing assembly 22. The fluid pressure flows into the conic-shaped end 342 of the chamber 338 in the sleeve 43. This pressure is applied to the flat end 346 of the pin 41, causing the pin to move to the closed position. One of the pin O-ring seals 324 prevents the fluid pressure thus applied from escaping around the pin. The pin is moved from the valve closed position of the valve open position by applying fluid pressure to valve opening conduit 44 while venting the valve closure conduit 42 to the interior of the casing assembly 22. The fluid pressure flows into the small diameter portion 341 of the cylindrical chamber 45. This pressure is applied to the neck 348 and head 350 of the pin, causing the pin to move toward the open position. Initially, the other pin O-ring seal 326 prevents the fluid pressure thus applied from escaping around the pin. As the head 350 passes this pin O-ring seal 326 and enters into the interior of the guide ring 322, the other pin O-ring seal 324 performs this function.

In the valve open position, the packer inlet/outlet conduit 50 fluidly communicates with the valve opening conduit 42 via the packer/valve conduit 54, the peripheral chamber 323 that surrounds the midsection 322*a* of the guide ring 322, the slot 325 in the guide ring 322, the interior of the guide ring 322, the hole in the pin O-ring seal 326, and the small diameter portion 341 of the cylindrical chamber 45. In the valve closed position, this communication path is cut off by the body of the pin 41 filling the hole in the pin O-ring seal 326.

Figure 13:
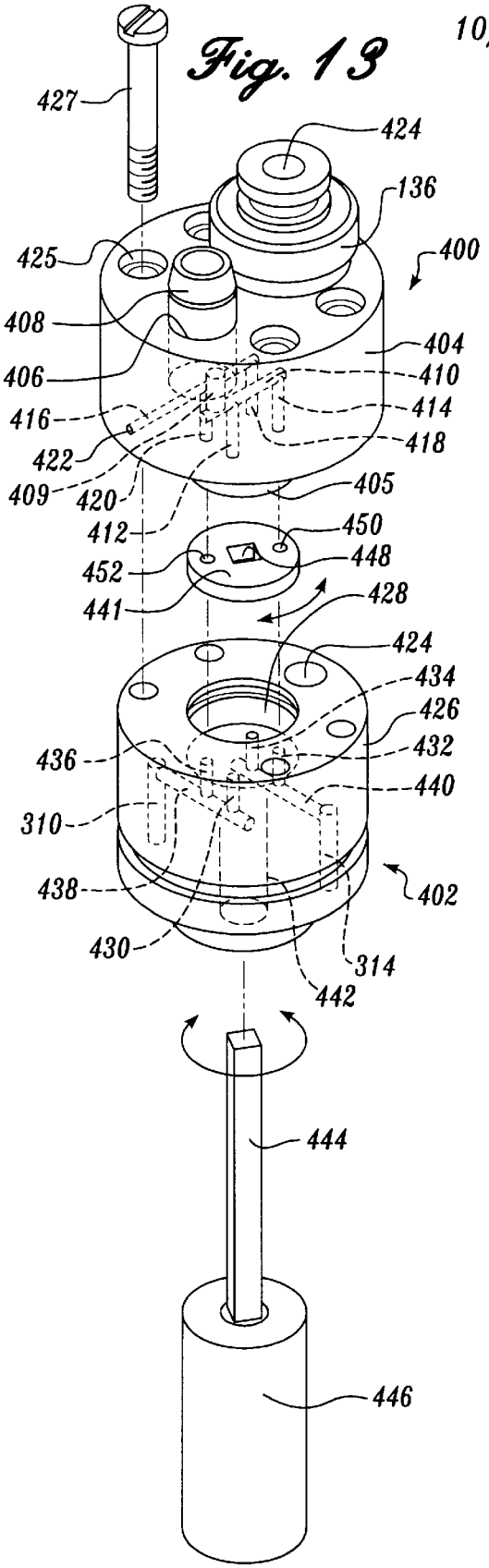
FIG. 13 is an exploded perspective view of the fluid interface and fluid manifold of the probe valve system of the present invention in the valve open configuration.
Figure 14:
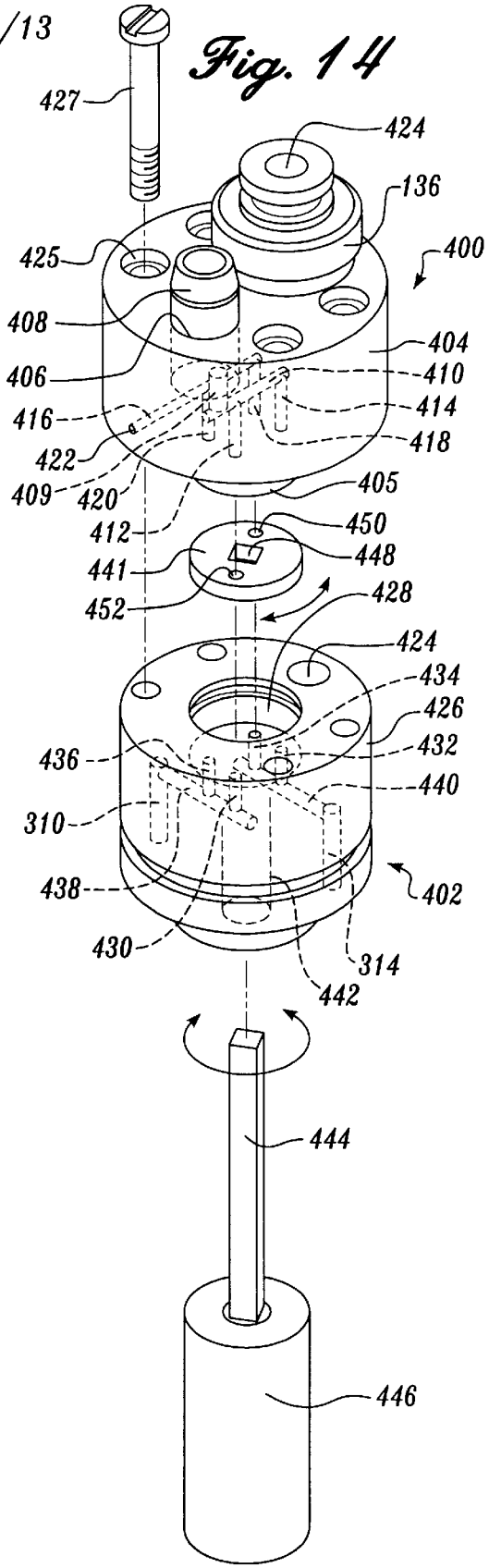
FIG. 14 is an exploded perspective view of the fluid interface and fluid manifold of the probe valve system of the present invention in the valve closed configuration.

The open/close state of the packer valve 36 is controlled by a fluid control system mounted in the packer inflation/deflation probe 124. FIGS. 13 and 14 show the fluid control system in the valve open configuration and the valve closed configuration, respectively. Referring additionally to FIG. 8, the fluid control system includes the fluid line 135, a fluid interface 400, and a fluid manifold 402. As previously described with respect to FIG. 5, the fluid line 135 is connected to the top of the packer inflation/deflation probe 124 adjacent the connector 136 connected to the MOSDAX control cable 137. Fluid line 135 supplies fluid, e.g., water, to the fluid interface 400. The fluid interface 400 is in fluid communication with the fluid manifold 402 in the manner described below. The fluid manifold 402 is connected to both the valve closure line 310 and the valve opening line 314. The fluid manifold 402 regulates passage of fluid from the fluid line 135 to the packer valve 36 through either the valve closure line 310 or the valve opening line 314. The fluid manifold 402 also regulates the venting of fluid from the packer 28 and the packer valve 36 to the external environment through either the valve closure line 310 or the valve opening line 314.

Referring specifically to FIGS. 13 and 14, the fluid interface 400 includes a unitary body 404 formed of a suitable metal alloy. The body has a centrally located neck 405 on its underside sized to fit into a hereinafter-described seat in the fluid manifold 402. The upper surface of the fluid interface body 404 includes bore 406 for receiving a hose nut 408. The hose nut 408 is a hollow member that houses a one-way valve. The hose nut couples the fluid line 135 to the fluid interface 400. The interior of the fluid interface body 404 includes an interface input conduit 409, an interface common input conduit 410, an interface closure input conduit 412, an interface opening input conduit 414, an interface common vent conduit 416, an interface closure vent conduit 418, an interface opening vent conduit 420, and a vent outlet 422 that vents to the interior of the casing assembly 22.

The interface common input conduit 410 is horizontally disposed in the fluid interface body 404 and is in fluid communication with the inner end of the one-way valve in the hose nut 408 via the interface input conduit 409. The interface closure input conduit 412 and the interface opening input conduit 414 are both vertically disposed in body 404 and are in fluid communication with the interface common input conduit 410. The interface closure input conduit 412 and the interface opening input conduit 414 both terminate at the bottom of the neck 405.

The interface common vent conduit 416 is horizontally disposed in the body 404 and, at one end, terminates in a vent outlet 422. The interface closure vent conduit 418 and the interface opening vent conduit 420 are both vertically disposed in the body 404 and are in fluid communication with the interface common vent conduit 416. The interface closure vent conduit 418 and interface opening vent conduit 420 both terminate at the bottom of the neck 405.

The fluid interface body 404 also includes a communications coupler 136 having a central bore 424. Bore 424 passes through both the fluid interface 400 and the fluid manifold 402 and provides a passageway for the MOSDAX control cable 137. The fluid interface body 404 also has a plurality of bolt openings 425 disposed around its outer periphery. The bolt openings 425 are sized to receive bolts 427. The bolts 427 secure the fluid interface 400 to the fluid manifold 402.

The fluid manifold 402 includes a body 426 formed of a suitable metal alloy. The fluid manifold body includes a centrally located circular seat 428 sized and positioned to mate with the neck 405 of the fluid interface 400. The interior of the fluid manifold 402 includes a manifold closure input conduit 430, a manifold open input conduit 432, a manifold closure vent conduit 434, a manifold opening vent conduit 436, a manifold common closure conduit 438, and a manifold common opening conduit 440. The manifold closure input conduit 430 and manifold opening vent conduit 436 are both vertically disposed in the fluid manifold body 426 and are in fluid communication with the horizontally disposed manifold common closure conduit 438. The manifold closure input conduit 430 and the manifold opening vent conduit terminate at the base of the seat 428. The manifold common closure conduit 438 is also in fluid communication with the valve closure line 310. The manifold opening input conduit 432 and the manifold closure vent conduit 434 are both vertically disposed in the fluid manifold body 426 and are in fluid communication with the horizontally disposed manifold common opening conduit 440. The manifold opening input conduit 432 and the manifold closure vent conduit 434 terminate at the base of the seat 428. The manifold common opening conduit 440 is also in fluid communication with the valve opening line 314 of the packer inflation/deflation probe 124.

As noted above, the neck 405 of fluid interface 400 is sized to fit into the seat 428 of fluid manifold 402. When the neck is positioned in the seat, it is oriented such that the terminal end of the interface closure input conduit 412 is aligned with the terminal end of the manifold closure input conduit 430; the terminal end of the interface opening input conduit 414 is aligned with the terminal end of the manifold opening input conduit 432; the terminal end of the interface closure vent conduit 418 is aligned with the terminal end of the manifold closure vent conduit 434; and the terminal end of the interface opening vent conduit 420 is aligned with the terminal end of the manifold opening vent conduit 436.

Located between the fluid interface 400 and the fluid manifold 402 is a valve plate 441. The valve plate 441 is circular and shaped to fit within the seat 428 between the bottom of the neck 405 and the base of the seat 428. The valve plate includes two orifices 450, 452 and a central rod orifice 448 that has a square shape. The first plate orifice 450 and the second plate orifice 452 are located at opposite sides of the central rod orifice 448, about 180° apart. As will be better understood from the following description, the valve plate 441 either obstructs fluid communication between the above-mentioned interface conduits 412, 414, 418, and 420 of the fluid interface 400 and the manifold conduits 430, 432, 434, and 436 of the fluid manifold 402, or selectively allows fluid flow therebetween.

The fluid manifold 402 has a rod opening 442 centrally located under seat 428. The rod opening 442 is large enough to allow the control rod 444 of a valve plate motor 446 to pass therethrough. As noted above, the valve plate 441 has a centrally located, square-shaped rod orifice 448. The rod orifice 448 is coaxially aligned with the rod opening 442 of the manifold 402. Further, the rod orifice 448 in the valve plate 441 is sized and shaped to mate with the control rod 444 of the valve plate motor 446. The spacing between the bottom of the neck 405 of the fluid interface 400 and the base of the seat 428 of the fluid manifold 402, when the fluid interface 400 is attached to the fluid manifold 402, is such that valve plate 441 is free to rotate therebetween upon actuation of the valve plate motor 446.

The plate motor 446 rotates the valve plate 441 through an arc of about 90° to place the valve plate 441 in either a valve open position in which the valve plate 441 allows fluid to pass through the packer valve 36, or a valve closed position in which the valve plate 441 prevents fluid from passing through the packer valve 36. In the valve open position, the first plate orifice 450 of the fluid plate 441 is aligned with the terminal ends of the interface opening input conduit 414 of the fluid interface 400 and the manifold opening input conduit 432 of the fluid manifold 402, thereby allowing fluid communication between these conduits forming the valve opening line 314. At the same time, the second plate orifice 452 of the valve plate 441 is aligned with the terminal ends of the interface opening vent conduit 420 and the manifold opening vent conduit 436, thereby allowing fluid communication between these conduits forming the valve closure line 310 leading to the vent outlet 422 facing the exterior of the probe 124. When in this position, the valve plate 441 blocks fluid communication between the terminal ends of the interface closure input conduit 412 and the manifold closure input conduit 430. Valve plate 441 also blocks fluid communication between the terminal ends of the interface closure vent conduit 418 and the manifold closure vent conduit 434.

In the just-described valve open position, which is depicted in FIG. 13, fluid from the fluid line 135 passes through the one-way valve in the hose nut 408 and enters the interface input conduit 409 of the fluid interface 400. The fluid then passes through the interface common input conduit 410 and enters the interface opening input conduit 414. The fluid passes through the first plate orifice 450 of the valve plate 441 and enters the manifold opening input conduit 432 of the fluid manifold 402. The fluid then passes through the manifold common opening conduit 440 and into the valve opening line 314. The fluid travels (FIG. 8) to the opening port 48 of the elongate casing 24 and enters the valve opening conduit 44 shown in FIGS. 7A–7D. The fluid pressure causes the pin 41 to move into the open position shown in FIG. 11 and described above. As the packer valve 36 opens, fluid enters the packer/valve conduit 54 and leaves the valve via the packer inlet/outlet conduit 50. The leaving fluid enters and pressurizes the packer 28.

After packer 28 has been pressurized with a predetermined amount of fluids the valve 36 is closed. The valve is closed by the valve plate motor 446 rotating the valve plate 441 to the valve closed position. This position is shown in FIG. 14. In the valve closed position, the first plate orifice 450 of the valve plate 441 is coaxially aligned with terminal ends of the interface closure vent conduit 418 of the fluid interface 400 and the manifold closure vent conduit 434 of the fluid manifold 402. The second plate orifice 452 of the valve plate 441 is coaxially aligned with the interface closure input conduit 412 and the manifold closure input conduit 430. The valve plate 441 thus blocks fluid communication between the interface opening input conduit 414 and the manifold opening input conduit 432. The valve plate 441 also blocks fluid communication between the interface opening vent conduit 420 and the manifold opening vent conduit 436. As before, fluid from the fluid line 135 passes through the one-way valve of the hose nut 408 and enters the interface input conduit 409 of the fluid interface 400. The fluid then passes through interface common input conduit 410 and enters interface closure input conduit 412. The fluid passes through the second plate orifice 452 of valve plate 441 and enters manifold closure input conduit 430. The fluid next passes through manifold common closure conduit 438 and enters valve closure line 310. The fluid then travels (FIG. 8) to the closure port 46 of elongate casing 24 and enters the valve closure conduit 42 shown in FIGS. 7A–7D. The fluid pressure causes the pin 41 to move into the closed position shown in FIG. 12 and described above, preventing fluid from flowing out of packer inlet/outlet conduit 50 and, thus, leaving the packer 28.

The packer 28 is deflated by first causing the valve plate motor 446 to rotate the valve plate 441 into the valve open position shown in FIG. 13 and described above. The resulting fluid pressure moves the pin 41 to the valve open position. However, rather than continuing, as occurs during inflation, fluid pressure ceases after the pin is moved to the packer valve 36 open position. Next, the valve plate motor 446 rotates the valve plate 441 to the valve closed position shown in FIG. 14 and described above. However, fluid flow from fluid line 135 is not reinitiated at this time. Consequently, the pin remains at the packer valve open position. As a result, the fluid pressure in packer 28 is coupled to the interface common vent conduit 416 and to the vent outlet 422. More specifically, the fluid leaves the packer 128 and enters the packer valve 36 through the packer inlet/outlet conduit 50. Next, the fluid flows into packer/valve conduit 54 and, since the packer valve 36 is open, passes through the packer valve. The fluid leaves the packer valve 36 through the valve opening conduit 44 and enters the opening port 48 of the elongate casing 24. The fluid then passes through valve opening port 149 of the packer inflation/deflation probe 124 and enters the valve opening line 314. The fluid travels to the manifold common opening conduit 440 and passes through the manifold closure vent conduit 434. The fluid passes through the first plate orifice 450 and enters the interface closure vent conduit 418. The fluid exits via the interface common vent conduit 416 and the vent outlet 422 to the exterior of the probe 124. After sufficient fluid has been vented from the packer 28, the packer valve 36 is closed by applying fluid pressure to the fluid line 135. The valve closes because the valve plate 441 is already in the valve closed position shown in FIG. 14.

The above-described construction of packer valve 36 is preferable when the packer valve 36 and the casing 24 are both made of steel or other metal materials. Forming the packer valve 36 and casing 24 with metal may be advantageous, for example, to minimize the outside diameter of the combined valve and casing. Minimizing the outside diameter is desirable in an application where clearances between the outside diameter of the combined valve and casing, and the inside diameter of a borehole are minimum.

When the outside diameter of the components need not be minimized, or when a casing 24 is made of plastic, an alternative packer valve 36*a* that is made of plastic may be used, as illustrated in FIGS. 15 through 17B.

Figure 15:
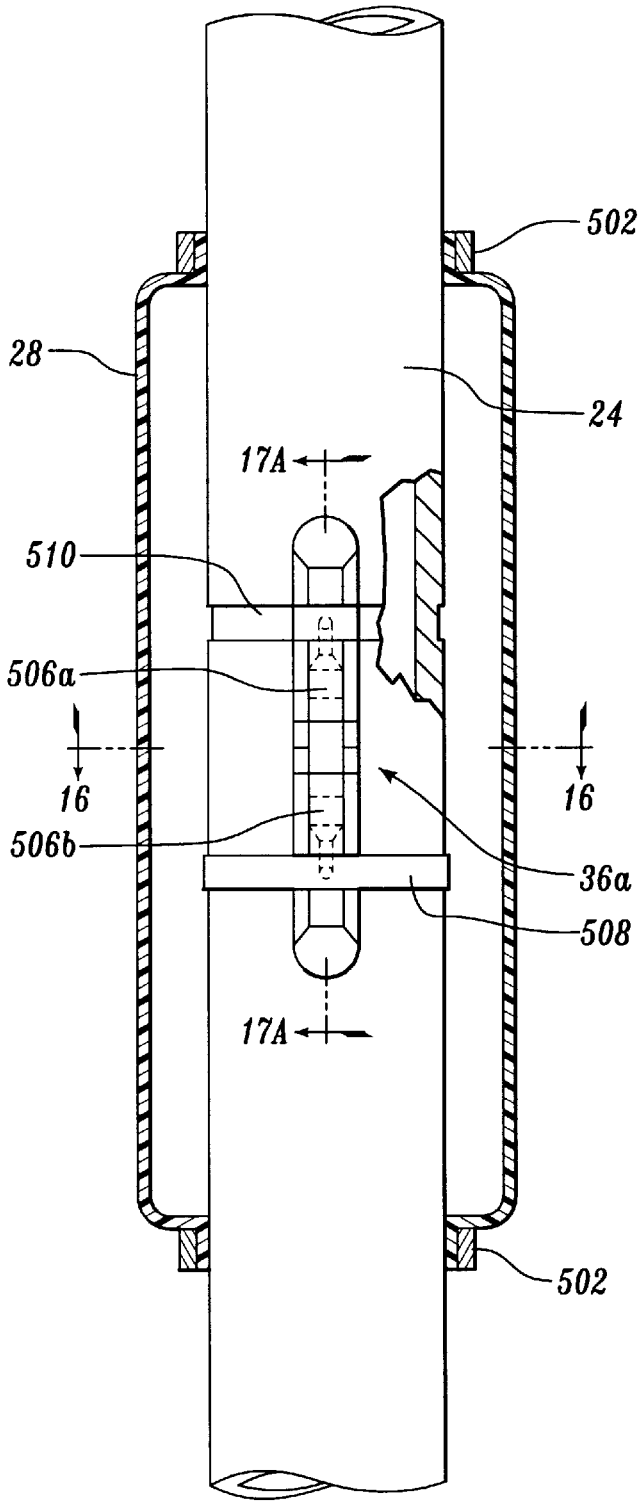
FIG. 15 is a diagrammatic elevation view of an elongate casing enclosed within a packer, showing another embodiment of a packer valve formed in accordance with this invention.

FIG. 15 illustrates a plastic valve 36*a* coupled to a casing 24. The casing 24 is disposed radially inside a packer 28. Both ends of the packer 28 are tightly secured to the casing, for example, by clamps 502. To better fit the clamps, the exterior surfaces of both ends of the casing 24 may include a circumferential groove (not shown).

Plastic valve 36*a* includes a first plastic housing 506*a*, and a second plastic housing 506*b* that is identical with the first plastic housing 506*a*. Each plastic housing 506*a*, 506*b* is individually attached to the casing 24 by suitable means, such as by a clamp 508. Only the clamp 508 attaching the second plastic housing 506 is shown in FIG. 15. The clamp attaching the first plastic housing is not shown so that, as before, FIG. 15 can show that, for the clamping purposes, the exterior surface of the casing 24 may include a circumferential groove 510, and the plastic housing may include a corresponding exterior groove 512.

Figure 16:
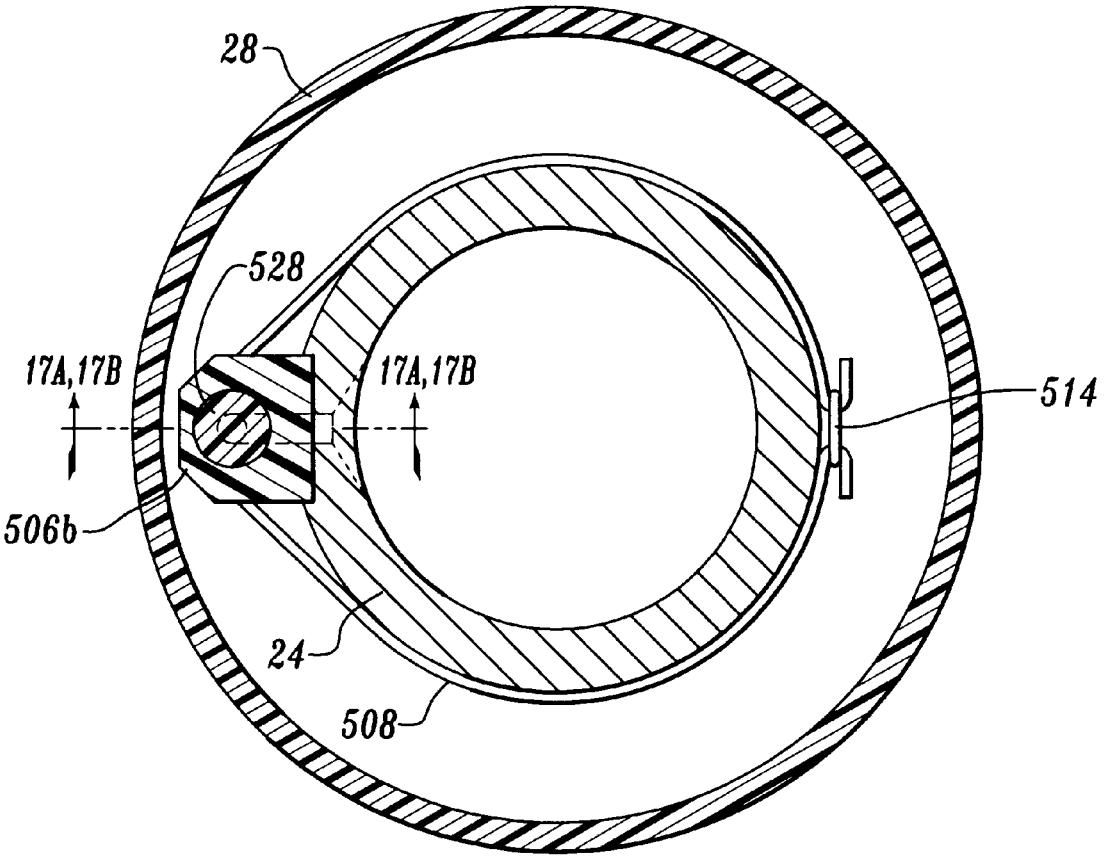
FIG. 16 is a cross-sectional view taken at section line 16—16 of FIG. 15 showing the casing and the packer valve clamped together.

FIG. 16 is a top cross-sectional view of the second plastic housing 506*b* attached to the casing 24 by clamp 508. The ends of clamp 508 pass through a metal ring 514 and are bent over. The metal ring 514 is located on the opposite side of the casing 24 from the plastic valve 36*a*. The metal ring 514 thus tightly holds the clamp 508.

Figure 17A:
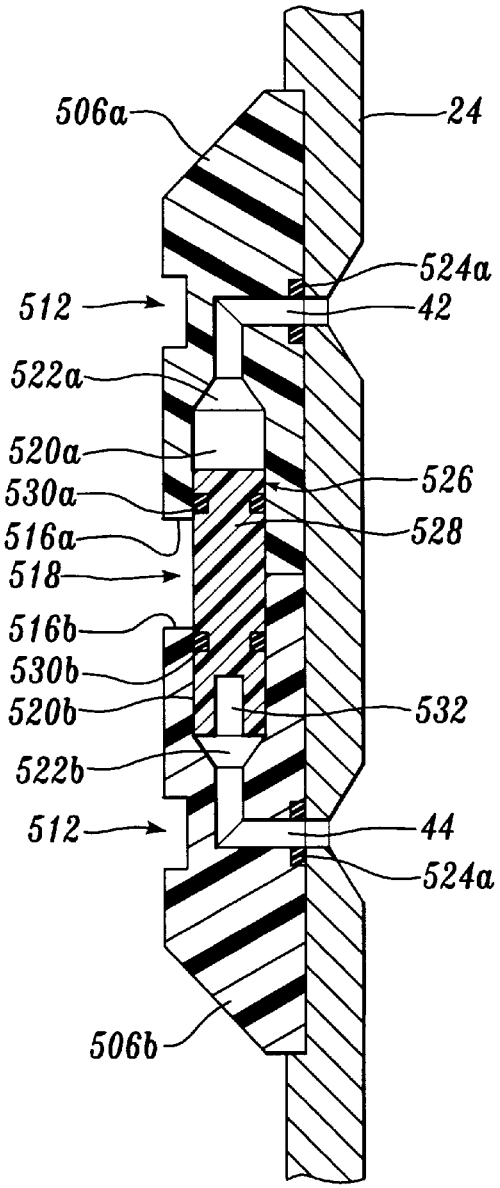
FIG. 17A is a partial sectional view taken at section line 17A—17A of FIG. 15 showing the packer valve pin in the closed position.
Figure 17B:
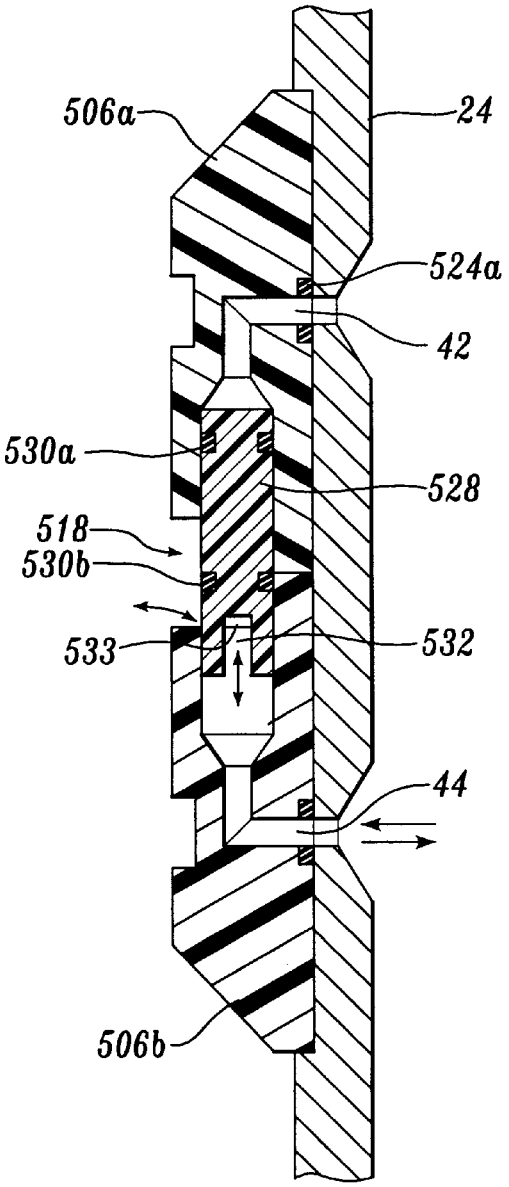
FIG. 17B is a partial sectional view taken at section line 17B—17B of FIG. 15 showing the packer valve pin in the open position.

Referring additionally to FIGS. 17A and 17B, the plastic housings 506*a* and 506*b* have cut ends 516*a* and 516*b*. The cut ends 516*a* and 516*b*, when abutted, form an opening 518 that is in direct communication with the interior of the packer 28. The first and second plastic housings 506*a* and 506*b* include generally cylindrical bores 520*a* and 520*b* starting from the cut ends 516*a* and 516*b* that extend substantially parallel to the elongate casing 24. The generally cylindrical bores end at tapered conical sections 522*a* and 522*b* that terminate at the valve closure conduit 42 and the valve opening conduit 44, respectively. As before, conduit-seal O-rings 524*a* and 524*b* lie in indentations that surround the ends of the valve closure conduit 42 and the valve opening conduit 44, respectively.

The bores 520*a* and 520*b* together form a valve pin chamber 526. A generally cylindrical valve pin 528 is disposed inside the valve pin chamber 526 so as to be longitudinally reciprocatable. The exterior surface of the valve pin includes a pair of circumferential grooves that accommodate pin-seal O-rings 530*a* and 530*b*, respectively. In construction, the first and second plastic housings 506*a*, 506*b* are molded or machined, and joined together after the valve pin 528 and the pin-seal O-rings 530*a*, 530*b* have been assembled and inserted. The pin-seal O-rings 530*a*, 530*b* are separated by a distance greater than the distance across the opening 518 between the cut ends 516*a*, 516*b* of the first and second plastic housing 506*a*, 506*b*. The valve pin 528 further includes a slot 532 that extends from one end of the pin 528 disposed within the second plastic housing 506*b*, through the valve pin 528, and terminates before the pin-seal O-ring 530*b*.

As shown in FIG. 17A, when the valve pin 528 is in its closed position, the pin-seal O-rings 530*a* and 530*b* lie on either side of the opening 518, thereby sealing the interior of the casing 24 from the interior of the packer 28.

FIG. 17B illustrates the valve pin 528 in its open position. When the valve pin 528 is pushed toward the first plastic housing 506*a*, one of the pin-seal O-rings 530*b* and at least a portion 533 of the slot 532 become exposed to the opening 518. This allows the valve opening conduit 44 to fluidly communicate with the interior of the packer 28 via the opening 518, as indicated by the arrows in FIG. 17B. The slot 532 provided through the valve pin 528 facilitates the flow of fluid between the valve opening conduit 44 and the opening 518. The mechanism for opening and closing the plastic valve 36*a* to inflate and deflate the packer 28 is the same as in the case of valve 36 described above.

While the foregoing describes the system including packer valves 36 or 36*a*, to inflate or deflate packer 28 outside the casing 24, the present system may also be used to open and close measuring ports for measuring, sampling, or pressure-sensing the underground exterior environment within a sampled zone 32. Specifically, those skilled in the art can easily combine the present system with a measurement probe and a coupler having two ports, as disclosed, for example, in the copending U.S. patent application, Ser. No. 09/149,269, filed Sep. 8, 1998, now U.S. Pat. No. 6,062,073, by the applicants and assigned to the Westbay Instruments Ltd., which is herein expressly incorporated by reference (Attorney Docket No. WBAY-1-10595).

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A valve for controlling the inflation and deflation of a packer mounted on a casing, said valve comprising:

a body having a bore, a valve closure conduit in communication with said bore, a valve opening conduit in communication with said bore, a packer inlet/outlet conduit connectable to a packer mounted on a casing, and a packer/valve conduit in communication with said bore and with said packer inlet/outlet conduit; and a pin reciprocatably mounted in said bore, said pin movable to a first position by fluid entering said valve closure conduit, said first position blocking said packer/valve conduit to prevent fluid from passing into and out of said packer, said pin movable to a second position by fluid entering said valve opening conduit, said second position allowing fluid to pass into and out of said packer through said packer inlet/outlet conduit and through said packer/valve conduit;

wherein said packer/valve conduit is in communication with said valve opening conduit when said pin is in said second position.

2. The valve of claim 1, further comprising:

a sleeve in said body, said sleeve including a longitudinal central hole that defines a portion of said reciprocation of said pin.

3. The valve of claim 1, further comprising:

a pair of fluid seals longitudinally spaced apart in said bore, between said valve closure conduit and said valve opening conduit, for dividing said bore into a central fluidtight compartment disposed between said fluid seals and two adjacent compartments on either side, between which said pin reciprocates.

4. The valve of claim 1, wherein said pin includes a portion having a constant cross-sectional area, said portion being fluid-tightly engageable with fluid seals to prevent reciprocal movement of said pin due either to pressure applied from said packer or to pressure of equal magnitude applied to both ends of said pin.

5. The valve of claim 1, wherein said pin is moved to said first portion by fluid entering said valve closure conduit and by venting through said valve opening conduit, and said pin is moved to said second position by fluid entering said valve opening conduit and by venting through said valve closure conduit.

6. The valve of claim 1, wherein said bore has an end adjacent said valve opening conduit, said end tapering to form a conic shape to facilitate the fluid flow to and from said packer.

7. An apparatus for inflating and deflating a packer mounted on a hollow casing, said apparatus comprising:

(a) a hollow casing having opposite open ends;

(b) a probe positionable within the hollow casing, said probe having a valve opening fluid line, a valve closure fluid line, a valve opening port in communication with said valve opening fluid line and a valve closure port in communication with said valve closure fluid line; and (c) a packer valve mounted on said hollow casing, said packer valve comprising:

(i) a body having: a bore; a valve closure conduit in communication with said valve closure port of said probe when said probe is suitably positioned in the casing, said valve closure conduit of said valve in communication with said bore; a valve opening conduit in communication with said valve opening port of said probe when said probe is suitably positioned in the casing, said valve opening conduit of said valve in communication with said bore; a packer inlet/outlet conduit in communication with said packer; and a packer/valve conduit in communication with said bore and with said packer inlet/outlet conduit; and (ii) a pin reciprocatably mounted in said bore, said pin movable to a first position by fluid entering said valve closure conduit from said valve closure port, said first position blocking said packer/valve conduit to prevent fluid from passing into and out of said packer, said pin movable to a second position by fluid entering said valve opening conduit, said second position allowing fluid to pass into and out of said packer, through said packer inlet/outlet conduit and through said packer/valve conduit.

8. The apparatus of claim 7, further comprising:

a sleeve in said body, said sleeve including a longitudinal central hole that defines a portion of said reciprocation of said pin.

9. The apparatus of claim 7, further comprising:

a pair of fluid seals longitudinally spaced apart in said bore, between said valve closure conduit and said valve opening conduit for dividing said bore into one central fluidtight compartment disposed between said fluid seals and two adjacent compartments on either side, between which said pin reciprocates.

10. The apparatus of claim 7, wherein said pin includes a portion having a constant cross-sectional area, said portion being fluid-tightly engageable with said fluid seals to prevent reciprocal movement of said pin due either to pressure applied from said packer or to pressure of equal magnitude applied to both ends of said pin.

11. The apparatus of claim 7, wherein said pin is moved to said first portion by fluid entering said valve closure conduit and by venting through said valve opening conduit, and said pin is moved to said second position by fluid entering said valve opening conduit and by venting through said valve closure conduit.

12. The apparatus of claim 7, wherein said bore has an end adjacent said valve opening conduit, said end tapering to form a conic shape to facilitate the fluid flow to and from said packer.

13. The apparatus of claim 7, wherein said hollow casing includes an interior surface forming a passageway extending between the opposite open ends of the body, and said probe includes a location member, said hollow casing further comprising:

a helical insert removably fitted within the passageway of the hollow casing, the helical insert having a helical shoulder curving around the longitudinal axis of the hollow casing and extending from an outer end located proximate to one open end of the hollow casing to an inner end remote from the open end, the helical shoulder being engageable by said location member radiating from said probe as said probe moves along the passageway in the hollow casing to guide the location member and rotate said probe so that the probe is turned to a desired orientation adjacent the packer valve.

14. The apparatus of claim 13, wherein said probe includes an extendible shoe braceable against the interior surface of the hollow casing to move said probe laterally within the tubular casing to press said valve opening port and said valve closure port of said probe into contact with said valve opening conduit and said valve closure conduit of said packer valve.

15. A casing assembly for mounting in a borehole comprising:

(a) a hollow casing;

(b) at least one fluid containing packer mounted on said hollow casing;

(c) a probe positionable within the hollow casing, said probe having a valve opening fluid line, a valve closure fluid line, a valve opening port in communication with said valve opening fluid line and valve closure port in communication with said valve closure fluid line; and (d) a valve mounted on said hollow casing, said valve comprising:

(i) a body having: a bore; a valve closure conduit in communication with said valve closure port of said probe when said probe is suitably positioned in the casing, said valve closure conduit of said valve in communication with said bore; a valve opening conduit in communication with said valve opening port of said probe when said probe is suitably positioned in the casing, said valve opening conduit of said valve in communication with said bore; a packer inlet/outlet conduit in communication with said packer; and a packer/valve conduit in communication with said bore and with said packer inlet/outlet conduit; and (ii) a pin reciprocatably mounted in said bore, said pin movable to a first position by fluid entering said valve closure conduit from said valve closure port, said first position blocking said packer/valve conduit to prevent fluid from passing into and out of said packer, said pin movable to a second position by fluid entering said valve opening conduit, said second position allowing fluid to pass into and out of said packer, through said packer inlet/outlet conduit and through said packer/valve conduit.

16. The casing assembly of claim 15, further comprising:

a sleeve in said body, said sleeve including a longitudinal central hole that defines a portion of said reciprocation of said pin.

17. The casing assembly of claim 15, further comprising:

a pair of fluid seals longitudinally spaced apart in said bore, between said valve closure conduit and said valve opening conduit, for dividing said bore into a central fluidtight compartment disposed between said fluid seals and two adjacent compartments on either side, between which said pin reciprocates.

18. The casing assembly of claim 15, wherein said pin includes a portion having a constant cross-sectional area, said portion being fluid-tightly engageable with said fluid seals to prevent reciprocal movement of said pin due either to pressure applied from said packer or to pressure of equal magnitude applied to both ends of said pin.

19. The casing assembly of claim 15, wherein said pin is moved to said first portion by fluid entering said valve closure conduit and by venting through said valve opening conduit, and said pin is moved to said second position by fluid entering said valve opening conduit and by venting through said valve closure conduit.

20. The casing assembly of claim 15, wherein said hollow casing includes an interior surface forming a passageway extending between the opposite open ends of the body, and said probe includes a location member, said hollow casing further comprising:

a helical insert removably fitted within the passageway of the hollow casing, the helical insert having a helical shoulder curving around the longitudinal axis of the hollow casing and extending from an outer end located proximate to one open end of the hollow casing to an inner end remote from the open end, the helical shoulder being engageable by said location member radiating from said probe as said probe moves long the passageway in the hollow casing to guide the location member and rotate said probe so that the probe is turned to a desired orientation adjacent the packer valve.

21. The casing assembly of claim 20, wherein said probe includes an extendible shoe braceable against the interior surface of said hollow casing to move laterally said probe within said hollow casing to press said valve opening fluid conduit and said valve closure fluid conduit of said probe with said valve opening conduit and said valve closure conduit of said valve.

22. A valve comprising:

a body having a bore, a valve closure conduit in communication with said bore, a valve opening conduit in communication with said bore, an inlet/outlet conduit connectable to the exterior of said body, and a connecting conduit in communication with said bore and with said inlet/outlet conduit; and a pin reciprocatably mounted in said bore, said pin movable to a first position by fluid entering said valve closure conduit, said first position blocking said connecting conduit to prevent fluid from passing into and out of the exterior of said body, said pin movable to a second position by fluid entering said valve opening conduit, said second position allowing fluid to pass into and out of the exterior of said body through said inlet/outlet conduit and through said connecting conduit;

wherein said connecting conduit is in communication with said valve opening conduit when said pin is in said second position.

23. The valve of claim 22, further comprising:

a sleeve in said body, said sleeve including a longitudinal central hole that defines a portion of said reciprocation of said pin.

24. The valve of claim 22, further comprising:

a pair of fluid seals longitudinally spaced apart in said bore, between said valve closure conduit and said valve opening conduit, for dividing said bore into a central fluidtight compartment disposed between said fluid seals and two adjacent compartments on either side, between which said pin reciprocates.

25. The valve of claim 22, wherein said pin includes a portion having a constant cross-sectional area, said portion being fluid-tightly engageable with said fluid seals to prevent reciprocal movement of said pin due either to pressure applied from the exterior of said tubular body, or to pressure of equal magnitude applied at both ends of said pin.

26. The valve of claim 22, wherein said pin is moved to said first position by fluid entering said valve closure conduit and by venting through said valve opening conduit, and said pin is moved to said second position by fluid entering said valve opening conduit and by venting through said valve closure conduit.

27. The valve of claim 22, wherein said bore has an end adjacent said valve opening conduit, said end tapering to form a conic shape to facilitate the fluid flow to and from the exterior of said tubular body.

28. A plastic valve mounted on a tubular body, said valve comprising:

a valve body having a bore, a valve closure conduit in communication with said bore, a valve opening conduit in communication with said bore, and an opening in communication with said bore and with the exterior of the valve body; and a pin reciprocatably mounted in said bore, said pin movable to a first position by fluid entering said valve closure conduit, said first position sealing said opening to prevent fluid from passing into and out of the exterior of said valve body, said pin movable to a second position by fluid entering said valve opening conduit, said second position allowing fluid to pass into and out of the exterior of said valve body-through said opening;

wherein said opening is in communication with said valve opening conduit when said pin is in said second position.

29. The valve of claim 28, wherein said pin includes a pair of fluid seals longitudinally spaced apart from each other by a distance that is greater than the distance across said opening, said fluid seals being fluid-tightly engageable with said bore to prevent reciprocal movement of said pin due either to pressure applied from the exterior of said valve body or to pressure of equal magnitude applied at both ends of said pin.

30. The valve of claim 28, wherein said pin is moved to said first position by fluid entering said valve closure conduit and by venting through said valve opening conduit, and said pin is moved to said second position by fluid entering said valve opening conduit and by venting through said valve closure conduit.

31. The valve of claim 28, wherein said pin has an end adjacent said valve opening conduit, said end including a slot to facilitate the fluid flow to and from the valve opening conduit.

* * * * *

UNITED STATES PATENT AND TRADEMARK OFFICE

CERTIFICATE OF CORRECTION

PATENT NO. : 6,192,982 B1
DATED : February 27, 2001
INVENTOR(S) : J.J. Divis et al.

It is certified that error appears in the above-identified patent and that said Letters Patent is hereby corrected as shown below:

Title page,
Item [56] References Cited, U.S. PATENT DOCUMENTS, "3,908,169 9/1975 Schufy et al." should read -- 3,908,769 9/1975 Schuyf et al. --
References Cited, OTHER PUBLICATIONS, "Instrument," should read -- Instruments, --

Column 19,
Line 24, "fluidtight" should read -- fluid-tight --

Column 20,
Line 17, "fluidtight" should read -- fluid-tight --

Column 21,
Line 35, "fluidtight" should read -- fluid-tight --
Line 62, "moves long" should read -- moves along --

Column 22,
Line 33, "fluidtight" should read -- fluid-tight --
Line 67, "body-through" should read -- body through --

Signed and Sealed this

Twenty-ninth Day of January, 2002

*Attest:*

*Attesting Officer*

JAMES E. ROGAN
*Director of the United States Patent and Trademark Office*